US012435526B2

(12) United States Patent
Pytlewski

(10) Patent No.: US 12,435,526 B2
(45) Date of Patent: Oct. 7, 2025

(54) TILE LIPPAGE CONTROL AND TILE SPACING SYSTEM AND METHOD THEREFORE

(71) Applicant: Marshalltown Company, Marshalltown, IA (US)

(72) Inventor: Walter Pytlewski, Post Falls, ID (US)

(73) Assignee: Marshalltown Company, Marshalltown, IA (US)

( * ) Notice: Subject to any disclaimer, the term of this patent is extended or adjusted under 35 U.S.C. 154(b) by 243 days.

(21) Appl. No.: 18/232,478

(22) Filed: Aug. 10, 2023

(65) Prior Publication Data

US 2025/0052076 A1 Feb. 13, 2025

(51) Int. Cl.

| | |
|---|---|
| ***E04F 21/22*** | (2006.01) |
| ***E04F 21/00*** | (2006.01) |
| ***E04F 21/18*** | (2006.01) |

(52) U.S. Cl.

CPC ..... *E04F 21/22* (2013.01); *E04F 21/0092* (2013.01); *E04F 21/1877* (2013.01)

(58) Field of Classification Search

CPC ... E04F 21/0092; E04F 21/22; E04F 21/1844; E04F 21/1877; E04F 13/0892; E04F 15/02005

See application file for complete search history.

(56) References Cited

U.S. PATENT DOCUMENTS

| | | | |
|---|---|---|---|
| 7,621,100 | B2 | 11/2009 | Kufner |
| 8,099,928 | B2 | 1/2012 | Kufner |
| 8,181,420 | B2 | 5/2012 | Torrents |
| 8,429,879 | B1 | 4/2013 | Hoffman |
| 9,027,308 | B2 | 5/2015 | Kufner |
| 9,228,363 | B2 | 1/2016 | Kufner |
| 9,470,002 | B2 | 10/2016 | Irvine |
| 9,482,018 | B2 | 11/2016 | Torrents |
| 9,562,365 | B2 | 2/2017 | Bucsa |

(Continued)

FOREIGN PATENT DOCUMENTS

| | | | |
|---|---|---|---|
| AU | 2014100939 | 9/2014 | |
| CA | 2887533 A1 * | 10/2016 | ..... E04F 21/0092 |

(Continued)

OTHER PUBLICATIONS

FASTcap™ Tiling Leveling System, https://marshalltown.com. 2022, NPL—FastCap.

*Primary Examiner* — Babajide A Demuren

(57) ABSTRACT

A tile lippage control and tile spacing system and method having an anchor that has a base portion and an interconnected anchor column, and the anchor column is breakably separable from the base portion, and the anchor column defines plural spaced annular rings; and a leveling base that one-way adjustably engages with the anchor column, the leveling base having, a toothed disc that is positionally secured within the leveling base and the toothed disc defines a medial hole that has plural teeth that operatively engage with the plural spaced annular rings of the anchor column, and a mid-plate that is axially movably engaged with the leveling base, and a compression spring that is carried within the interior cavity defined by the leveling base and which communicates with both the leveling base and the mid-plate so as to positionally bias and space the leveling base away from the mid-plate.

20 Claims, 12 Drawing Sheets

(56) References Cited

U.S. PATENT DOCUMENTS

| | | | | |
|---|---|---|---|---|
| 9,657,485 | B2 * | 5/2017 | Meyers | E04F 21/22 |
| 9,874,032 | B1 | 1/2018 | Chen | |
| 9,945,133 | B2 | 4/2018 | Hoffman | |
| 10,053,872 | B2 | 8/2018 | Sighinolfi | |
| 10,151,118 | B2 | 12/2018 | Irvine | |
| 10,407,923 | B2 | 9/2019 | Psaila | |
| 10,508,458 | B1 | 12/2019 | Charitou | |
| 10,538,925 | B2 | 1/2020 | Ghelfi | |
| 10,604,945 | B2 | 3/2020 | Volponi | |
| 11,002,023 | B2 | 5/2021 | Busby | |
| 11,002,025 | B2 | 5/2021 | Sighinolfi | |
| 2006/0185269 | A1 | 8/2006 | Kufner | |
| 2015/0184355 | A1 | 7/2015 | Wang | |
| 2016/0298342 | A1 * | 10/2016 | Moon | E04F 21/20 |
| 2018/0100315 | A1 | 4/2018 | Volponi | |
| 2019/0127994 | A1 | 5/2019 | Cipriani | |

FOREIGN PATENT DOCUMENTS

| | | | | |
|---|---|---|---|---|
| CN | 204139562 | | 2/2015 | |
| DE | 29810627 | | 10/1998 | |
| EP | 2514886 | | 10/2012 | |
| EP | 2966238 | A1 * | 1/2016 | E04F 21/0092 |
| EP | 2775068 | | 6/2017 | |
| WO | 2018172802 | | 9/2018 | |

* cited by examiner

TILE LIPPAGE CONTROL AND TILE SPACING SYSTEM AND METHOD THEREFORE

TECHNICAL FIELD

The present invention relates generally to the field of surface coverings, and more particularly to the field of tiles and the placement and installation of tiles on floor surfaces and wall surfaces. Still even more particularly, the present invention relates to a device, system and method for accurately controlling tile lippage during the installation of tiles, and accurately controlling spacing between adjacent tiles during installation.

BACKGROUND OF THE INVENTION

Tile lippage is a variation in the planar position of an exterior surface of a tile, relative to the planar position of an exterior surface of an adjacent tile. Tile lippage may be a safety hazard which may cause tripping on a walking surface and also diminishes the aesthetic appearance of installed tiles. For those reasons, amongst others, eliminating tile lippage during the installation of tiles is perhaps the primary objective of artisans installing tiles.

Known prior art disclose a variety of devices for leveling tiles which are used for bringing the upper/exposed/exterior surfaces of a plurality of tiles into the same plane. In the laying of tiles (on a floor surface, or a wall surface, or otherwise) the underlying surface may not be perfectly planar due to irregularities in the underlying supporting surface; and/or irregularities in the distribution of adhesive substrates; and/or dissimilar thicknesses in adjacent tiles. In order to make the upper/exposed surfaces of the tiles coplanar, leveling devices are used.

Known tile leveling devices, generally fall into two categories: (1) threaded tighteners which generally have two components, each component having one half of a pair of mating threads, so that rotation of one component, relative to the other component, causes the two components to move, along the engaged mating threads, axially toward one another so as to "squeeze" the adjacent tiles therebetween, responsively eliminating tile lippage and leveling the tiles; and (2) ramp type levelers which generally have three components, one component defining a predetermined fixed opening, a second component defining a stepped ramp, that is inserted at least partially into the predetermined fixed opening and a third base portion that operatively communicates with the first portion defining the fixed opening, and that is partially under the tiles and partially above the tiles, and movement of the first component, along the stepped ramp draws the base portion upwardly, similarly "squeezing" the adjacent tiles therebetween, responsively eliminating lippage and leveling a tiles. Ramp type levelers also generally require two hands to utilize, (one hand to hold the first component, and the second hand to handle the second component) which can exacerbate back issues for installers.

Perhaps second, only to eliminating tile lippage, there is the need for accurate and consistent spacing between adjacent tiles. Closely and consistently spaced tiles provide linear, and parallel, grout lines which provide aesthetic appeal, and minimize moisture absorption. Maintaining accurate and consistent spacing between adjacent tiles, especially when tiles are laid over a vast planar area (such as a large floor, or large wall) has always been, and remains difficult. The presence of irregular, nonlinear, non-consistent grout lines is evidence of amateur tile installation.

Known devices for controlling tile lippage, and maintaining accurate spacing between adjacent tiles have a variety of drawbacks.

One known drawback is that axial rotation of tighteners is time-consuming, and subjects installers to repetitive stress injuries, such as, but not limited to, carpal tunnel syndrome. Each tightening device needs to be axially oriented with the second component, the first component needs to be repeatedly axially rotated relative to the second component to the appropriate tension, the installer needs to ensure the tightening of the first component does not cause the adjacent tiles to move laterally relative to one another which causes the spacing therebetween to change; the tightening of adjacent devices may alter the tension of previously tightened devices; and for removal, the tightener needs to again be axially rotated to remove the first component from the second. As described, use of known axial rotation tighteners is time-consuming, and duplicative because the axial rotation must occur twice; once for tightening, and once for loosening. Thereafter, the first component that is extending generally outwardly from between the adjacent tiles, must be separately removed and/or fractured at a position below the top surface of the tiles so that the component does not to interfere with installation of grout.

Known tile leveling devices that use both axial rotation, and stepped ramps both tend to exert a lateral component of force upon the tiles as the device is tightened upon the tiles. The lateral component of force tends to force the tiles under the device apart/distally from one another which can, and frequently does, cause joint lines to be unequal and nonlinear which negatively affects the aesthetic appearance of the finished product and may make the finished product more subject to cracking, tile loss and moisture absorption.

A still further known drawback of known tile leveling devices is that the portion/component of the device that is positioned at least partially under and between the adjacent tiles must be cut or otherwise fractured to be removed. The cut location/fracture location must be below/under the exterior/exposed surface of the adjacent tiles, and within the space between the tiles, so that the fracture location may be sufficiently covered by, and obscured by, grout that is thereafter placed within the space between the tiles. Generally, this cutting/fracturing requires a separate tool, and a separate process after the substrate adhesively securing the tiles to the supporting surface has hardened/cured and after the first component of the tile leveling device has been removed/disconnected from the second component. This cutting/fracturing is a third time-consuming "step" in the laying of tiles.

An even still further drawback of known tile leveling devices is that they frictionally move along/across/upon the exposed surface of the tile (rotationally, slidably, etc.). This frictional movement, in abrasive filled environments, commonly scratches the exposed surface of the tile and causes damage thereto—which can still further diminish the aesthetic appeal of the finished tile surface. Cleaning and/or preventing abrasives from depositing on the surfaces adds yet another step in the tile laying process and increases costs and time.

What is needed is a tile leveling device which accurately and consistently controls tile lippage and simultaneously accurately and consistently controls tile spacing. What is further needed is a tile leveling device which does not subject to user to repetitive stress injuries, eliminates duplicative work, and can be installed/operated with one hand. Further still, what is needed is a tile leveling device that does not slide along/upon the exposed surface of the tile which may damage the tile. Even further still, what is needed is a tile leveling device that saves time, makes tile installation more efficient, and a device that intentionally fractures/breaks at a predetermined location that is below/under an exterior/exposed surface of the tile so that grout maybe installed thereover.

The present invention overcomes various of the aforementioned drawbacks to known prior art tile leveling and tile spacing devices, and provides several advantages over the prior art references, and practices utilized, heretofore. More specifically, the present invention is a tile lippage control device and tile spacing system and method therefore that is axially (not threadably rotatably engageable) with a base member that has a predetermined breakaway point that is positioned vertically below/under the exterior/exposed surface of the adjacent tile.

SUMMARY OF THE INVENTION

The present invention is a system and method for controlling lippage of tiles and spacing of tiles, and generally provides a leveling base having a tapered leveling base insert, a toothed disk, a compression spring and a mid-plate; and an anchor that is axially one-way engageable with the leveling base.

A principal aspect of the present invention is a tile leveling and tile spacing apparatus comprising: an anchor 100 having an anchor column 131, a base portion 102 and an anchor column extension 141 between the anchor column 131 and the base portion 102; and a leveling base 10 having a leveling base insert 40, a toothed disc 60, a compression spring 70 and a mid-plate 80; and wherein the base portion 102 of the anchor 100 has a top surface 103, a bottom surface 104 that is substantially planar, and a peripheral edge 105 that extends about the base portion 102, and plural spacedly arrayed through cut outs 106 are defined in the base portion 102, and the base portion 102 has a tapering thickness 109 such that a thickness of the base portion 102 is smallest adjacent to the peripheral edge 105, and a tile spacer 118 is carried on the top surface 103 of the base portion 102 and the tile spacer 118 extends generally perpendicularly upwardly therefrom, and the tile spacer 118 defines a height dimension 121 and a thickness dimension 119 between a first side 122 and a second side 123; and the anchor column extension 141 is generally rectilinear in peripheral configuration and interconnects the anchor column 131 to the base portion 102, and the anchor column extension 141 has a first end portion 146 that structurally communicates with a bottom end portion 134 of the anchor column 131, and a second end portion 147 that structurally communicates with the top surface 103 of the base portion 102, and the anchor column extension 141 has a first side 142, a second side 143, a first lateral edge 144 and a second lateral edge 145, and the anchor column extension 141 is designed to fracture/break at a predetermined location 148 between the bottom end portion 134 of the anchor column 131 and the top surface 103 of the base portion 102, and the anchor column 131 is breakably/destructively separable from the anchor 100 generally along the anchor column extension 141, and a thickness dimension of the anchor column extension 141 between the first side 142 and the second side 143 is equal to, or less than, the thickness dimension 119 of the tile spacer 118; and the anchor column 131 of the anchor 100 is generally cylindrical in configuration and has a beveled top end portion 133 that is beveled, and the bottom end portion 134 of the anchor column 131 structurally communicates with the first end portion 146 of the anchor column extension 141, the anchor column 131 defines a length 149 between the top end portion 133 and the bottom end portion 134, an axis 135, and the anchor column 131 defines plural spacedly arrayed, and circumferentially extending, annular rings 136 along the length 149 of the anchor column 131, and each of the plural spacedly arrayed annular rings 136 defines a minor diameter 137, and a major diameter 138, and each of the plural spacedly arrayed annular rings 136 defines an upper surface 139 that has a downwardly and outwardly tapered edge portion at an outer circumferential edge 132, and each of the plural spacedly arrayed annular rings 136 defines a bottom surface 140 that communicates with the outer circumferential edge 132; and the mid-plate 80 is cup-like in configuration having a body 93 that has a top portion 81 that defines a peripheral edge 95, a bottom portion 82, an outer circumferential surface 83 that defines an outer diameter 87, and plural spacedly arrayed through notches 84 that communicate with the peripheral edge 95 at the top portion 81, and the body 93 defines an interior cavity 85 that has an opening orifice 86 at the top portion 81 and a closed bottom portion 94 within the interior cavity 85 opposite the opening orifice 86, and radially outwardly extending engagement tabs 88 are carried on the outer circumferential surface 83 at the peripheral edge 9S adjacent the opening orifice 86, and the engagement tabs 88 are spacedly arrayed about the peripheral edge 95, and an axially aligned boss 91 is carried on an upper surface of the closed bottom 94 within the interior cavity 85, and an axially aligned through hole 89 is defined in the axially aligned boss 91 in the closed bottom portion 94 so that the anchor column 131 of the anchor 100 may pass axially therethrough, the axially aligned hole 89 further defines an axis 92, and a diameter 90; and the compression spring 70 is a coil spring formed of metal and has a top portion 71, a bottom portion 72, an exterior diameter 74, a length dimension 76 between the top portion 71 and the bottom portion 72, and the coils define a medial channel 73 that has an interior diameter 75, and the compression spring 70 is carried within the interior cavity 85 of the mid-plate 80 and the bottom portion 72 of the compression spring 70 frictionally rests upon the closed bottom portion 94 of the mid-plate 80, and the axially aligned boss 91 of the mid-plate 80 is positioned within the medial channel 73 defined by the compression spring 70; and the leveling base 10 is axially movably interconnected with the mid-plate 80 and adjustably engages, in only one direction, with the anchor column 131 of the anchor 100, and the leveling base 10 has a body 11 that has an inverted cup-like configuration with a closed top portion 12, an open bottom portion 13, an outer circumferential surface 14 that has an exterior diameter 16 and which defines plural spacedly arrayed and radially outwardly extending gripping protrusions 15, the body 11 further defines an interior cavity 17 that opens downwardly and has an interior diameter 35 and an interior circumferential surface 18, and the interior circumferential surface 18 of the body 11 defines a recess 19 to engage with the engagement tabs 88 of the mid-plate 80, the body 11 further defines an axially aligned medial through hole 20 in the closed top portion 12, and the axially aligned medial through hole 20 has an axis 36, and an annular sleeve 22 which is axially aligned with the axis 36, is carried by the body 11 inside the interior cavity 17 and the annular sleeve 22 has a first end portion 23 that is structurally attached to an underside of the closed top portion 12 within the interior cavity 17, a second end portion 24, an outer circumferential surface 31 having an exterior diameter 32, and the annular sleeve 22 further defines an axially aligned medial channel 29 extending therethrough, that has an inner circumferential surface 34 and an inner diameter 33, and the axially aligned medial channel 29 has a length 25 that extends from the first end portion 23 to the second end portion 24, and the axially aligned medial channel 29 has an axis 26 which is axially aligned with an axis 36 of the medial hole 20 defined in the closed top portion 12, and the medial channel 29 has a radially reduced interior shoulder 30 proximate the second end portion 24, and the annular sleeve 22 further defines an annular pocket 28 at the second end portion 24 for axial engagement with the axially aligned boss 91 carried within the interior cavity of the mid-plate 80; and a toothed disc 60 formed of a metal is carried within the axially aligned medial channel 22 and frictionally rests upon the radially reduced interior shoulder 30, the toothed disc 60 having, a generally annular configuration with an outer circumferential edge 69, a top surface 61, a bottom surface 62, an exterior diameter 63, and an axially aligned medial hole 64 that has a diameter 66, and an peripheral edge 68, and plural teeth 65 are carried by and extend generally radially inwardly and upwardly from the peripheral edge 68 of the medial hole 64, and each of the plural teeth 65 has a tip portion 67, and diametrically opposed tip portions 67 of the toothed disc 80 define a passage 59 for the anchor column 131 and at least a number of the plural spaced annular rings 136 carried thereon to pass therethrough in only one direction; and a tapered leveling base insert 40 having a generally tubular configuration, is fixedly carried within the medial channel 29 defined by the annular sleeve 22 of the leveling base 10, and the leveling base insert 40 is immediately adjacent the top surface 61 of the toothed disc 60 and positionally secures the toothed disc 60 upon the radially reduced interior shoulder 30, the leveling base insert 40 has a first end portion 41, a second end portion 42, an outer circumferential surface 43 that defines an exterior diameter 45, a length 44 defined between the first end portion 41 and the second end portion 42, and defines an axially aligned medial channel 46 that extends between the first end portion 41 and the second end portion 42, and the axially aligned medial channel 46 has a major diameter 47, and plural elongate and spacedly arrayed radially inwardly extending vanes 48 are carried within the axially aligned medial channel 46, and a minor diameter 49 of the axially aligned medial channel 46 is defined between diametrically opposed and proximate radially inwardly extending vanes 48, and radially inward edge portions 50 of the radially inwardly extending vanes 48 operatively frictionally communicate with the anchor column 131 to guide axial movement of the anchor column 131 within and through the medial channel 46; and the compression spring 70 top portion 71 operatively frictionally communicates with an underside of the closed top portion 12 of the leveling base 10, and the compression spring 70 bottom portion 72 operatively frictionally communicates with an upwardly facing surface of the closed bottom portion 94 of the mid-plate 80, and because the length dimension 76 of the compression spring 70 is greater than the length dimension 25 of the annular sleeve 22, the compression spring 70 positionally biases the leveling base body 11 axially distally away from the mid-plate 80 to an axially extended position where the engagement tabs 88 carried by the mid-plate 80 and which are engaged within the tab recesses 19 defined in the interior circumferential surface 18 of the interior cavity 17 prevent the mid-plate 80 from disengaging from the leveling base 10, and the compression spring 70 is axially positionally secured within the interior cavity 17 by the annular sleeve 20 which is positioned within the medial channel 73 defined by the compression spring 70 coils; and frictional engagement of the plural teeth 65 of the toothed disc 60 with the anchor column 131 and at least a number of the spacedly arrayed annular rings 136 thereon draws the base portion 102 of the anchor 100 closer to the bottom portion 82 of the mid-plate 80 which causes tiles 200 that are immediately adjacent the anchor column extension 141 and which the base portion 102 of the anchor 100 is underneath, to move into planar linear alignment, and predetermined spaced alignment.

A further aspect of the present invention is a tile leveling and tile spacing apparatus comprising: an anchor 100 having an anchor column 131 and a base portion 102 and the anchor column 131 is interconnected with, and is breakably separable from, the base portion 10, and wherein the anchor column 131 defines plural spaced annular rings 136 along a length 149 of the anchor column 131; and a leveling base 10 that one-way adjustably engages with the anchor column 131, the leveling base having, a toothed disc 60 that is positionally secured within the leveling base 10, the toothed disc 60 defining a medial hole 64 with plural radially inwardly extending teeth 65 that frictionally engage with the anchor column 131 and the plural spaced annular rings 136 thereon, and a mid-plate 80 that is carried substantially within an interior cavity 17 defined by the leveling base 10, and of the mid-plate is movably engaged with the leveling base 10; and a compression ring 70 that is carried within the interior cavity 17 defined by the leveling base 10 and which communicates with both the leveling base 10 and the mid-plate 80 to positionally bias the leveling base 10 away from the mid-plate 80.

A further aspect of the present invention is a tile leveling and tile spacing apparatus, and further comprising: a tile spacer 118 on a top surface 103 of the base portion of the anchor 100, and the tile spacer 118 has a first side portion 122, a second side portion 123 and a thickness dimension 119 between the first side portion 122 and the second side portion 123.

A further aspect of the present invention is a tile leveling and tile spacing apparatus wherein plural spacedly arrayed tile spacers 118 on a top surface 103 of the base portion 102 of the anchor 100 are configured, relative to one another, and relative to the anchor column 131, to facilitate a linear tile joint between adjacent edge portions of spacedly adjacent tiles 200.

A further aspect of the present invention is a tile leveling and tile spacing apparatus wherein plural spacedly arrayed tile spacers 118 on a top surface 103 of the base portion 102 of the anchor 100 are configured, relative to one another, and relative to the anchor column 131, to facilitate a corner "T" joint between adjacent corner and edge portions of spacedly adjacent tiles 200.

A further aspect of the present invention is a tile leveling and tile spacing apparatus wherein plural spacedly arrayed tile spacers 118 on a top surface 103 of the base portion 102 of the anchor 100 are configured, relative to one another, and relative to the anchor column 131, to facilitate a four-corner joint between adjacent corner portions of spacedly adjacent tiles 200.

A further aspect of the present invention is a tile leveling and tile spacing apparatus wherein plural spacedly arrayed tile spacers 118 on a top surface 103 of the base portion 102 of the anchor 100 are configured, relative to one another, and relative to the anchor column 131, to facilitate a joint between adjacent edge portions plural spacedly adjacent tiles 200.

A further aspect of the present invention is a tile leveling and tile spacing apparatus wherein the mid-plate 80 has a bottom portion 82 that is substantially planar in configuration, and the substantially planar bottom portion 82 of the mid-plate 80 frictionally simultaneously rests upon a generally planar top surface 201 of plural adjacent tiles 200; and the compression spring 70, operatively acting upon both the mid-plate 80, and the leveling base 10, draws the base portion 102 of the anchor 100 which is positioned at least partially under plural adjacent tiles 200 closer to the substantially planar bottom portion 82 of the mid-plate 80 responsively causing the generally planar top surface 201 of the plural adjacent tiles 200 to be co-planar with one another.

A further aspect of the present invention is a tile leveling and tile spacing apparatus wherein the leveling base 10 and the mid-plate 80 are axially movably interconnected with one another, and the compression spring 70 biases the leveling base 10 away from the mid-plate 80.

A further aspect of the present invention is a tile leveling and tile spacing apparatus, and further comprising: a medial hole 20 defined in a closed top portion of a body 11 of the leveling base 10, and the medial hole 20 defines an axis 36 extending therethrough; and an annular sleeve 22 is carried by a body 11 of the leveling base 10 inside a downwardly opening interior cavity 17 defined by the leveling base 10 body 11, and the annular sleeve 22 has a first end portion 23 that is structurally attached to an underside of the closed top portion 12 of the body 11 within the interior cavity 17, a second end portion 24, an outer circumferential surface 31 having an exterior diameter 32, and the annular sleeve 22 further defines an axially aligned medial channel 29 extending therethrough, and the axially aligned medial channel 29 has an inner circumferential surface 34, an inner diameter 33, and a length 25 that extends from the first end portion 23 to the second end portion 24, and the axially aligned medial channel 29 has an axis 26 which is axially aligned with the axis 36 of the medial hole 20 defined in the closed top portion 12, and the medial channel 29 has a radially reduced interior shoulder 30 proximate the second end portion 24; and a tapered leveling base insert 40 that has a generally tubular configuration, is fixedly carried within the medial channel 29 defined by the annular sleeve 22 of the leveling base 10, the leveling base insert 40 has a first end portion 41, a second end portion 42, an outer circumferential surface 43 that defines an exterior diameter 45, a length 44 defined between the first end portion 41 and the second end portion 42, and defines an axially aligned medial channel 46 that extends between the first end portion 41 and the second end portion 42; and the leveling base insert 40 positionally secures the toothed disc 60 within the medial channel 29 of the annular sleeve 22 and immediately adjacent the radially reduced interior shoulder 30 within the medial channel 29.

A further aspect of the present invention is a tile leveling and tile spacing apparatus wherein engagement of the leveling base insert 40 within the medial channel 29 defined by the annular sleeve 22 is a friction fit.

A further aspect of the present invention is a tile leveling and tile spacing apparatus wherein engagement of the leveling base insert 40 within the medial channel 29 defined by the annular sleeve 22 is made with an adhesive.

A further aspect of the present invention is a tile leveling and tile spacing apparatus wherein engagement of the leveling base insert 40 within the medial channel 29 defined by the annular sleeve 22 is made with a fastener.

A further aspect of the present invention is a tile leveling and tile spacing apparatus wherein the anchor column 131 of the anchor 100 may pass axially through the medial hole 64 defined in the toothed disc 60 in only one direction.

A further aspect of the present invention is a tile leveling and tile spacing apparatus wherein the compression spring 70 has a tension of between approximately 30 pounds and 110 pounds.

A further aspect of the present invention is a tile leveling and tile spacing apparatus wherein the compression spring 70 is formed of high carbon spring steel.

A further aspect of the present invention is a tile leveling and tile spacing apparatus wherein the compression spring 70 is formed of plated high carbon spring steel.

A further aspect of the present invention is a tile leveling and tile spacing apparatus wherein the compression spring 70 is formed of stainless steel.

An even still further aspect of the present invention is a method to consistently space a tile 200 a predetermined desired distance from an adjacent tile 200, and to consistently level adjacent tiles 200 while the tiles 200 are being set in a substrate, so as to form a finished planar surface, the method comprising the steps: providing a surface that is at least partially covered with the substrate; providing at least two tiles 200 to be placed adjacent one another in the substrate with the predetermined desired distance between adjacent edge portions 203 of the at least two tiles 200; providing an anchor 100 having an anchor column 131, a base portion 102 and an anchor column extension 141 between the anchor column 131 and the base portion 102; and providing a leveling base 10 having a tapered leveling base insert 40, a toothed disc 60, a compression spring 70 and a mid-plate 80; and wherein the base portion 102 of the anchor 100 has a top surface 103, a bottom surface 104 that is a substantially planar, and a peripheral edge 105 that extends about the base portion 102, and plural spacedly arrayed through cut-outs 106 are defined in the base portion 102, and the base portion 102 has a tapering thickness 109 such that a thickness of the base portion 102 is smallest adjacent to the peripheral edge 105, and a tile spacer 118 is carried on the top surface 103 of the base portion 102 and the tile spacer 118 extends generally perpendicularly upwardly therefrom, and the tile spacer 118 defines a thickness dimension 119 between a first side portion 122 and a second side portion 123, and a height dimension 121; and the anchor column extension 141 is generally rectilinear in peripheral configuration, and the anchor column extension 141 has a first end portion 146 that structurally communicates with a bottom end portion 134 of the anchor column 131, and the anchor column extension 141 has a second end portion 147 that structurally communicates with the top surface 103 of the base portion 102 of the anchor 100, and the anchor column base 141 has a first side 142, a second side 143, a first lateral edge 144 and a second lateral edge 145, and the anchor column extension 141 is designed to fracture/break at a predetermined location 148 between the bottom end portion 134 of the anchor column 131 and the top surface 103 of the base portion 102, and the anchor column 131 is breakably/destructively separable from the anchor 100 generally along the anchor column extension 141, and a thickness dimension of the anchor column extension 141 between the first side 142 and the second side 143 is equal to, or less than, the thickness dimension 119 of the tile spacer 118; and the anchor column 131 of the anchor 100 is substantially cylindrical in configuration and has a beveled top end portion 133 that is beveled, and the bottom end portion 134 of the anchor column 131 structurally communicates with the first end portion 146 of the anchor column extension 141, the anchor column 131 defines a length 149 between the beveled top end portion 133 and the bottom end portion 134, an axis 135, and the anchor column 131 defines plural spacedly arrayed, and circumferentially extending, annular rings 136 along the length 149 of the anchor column 131, and each of the plural spacedly arrayed annular rings 136 defines a minor diameter 137, and a major diameter 138, and each of the plural spacedly arrayed annular rings 136 defines an upper surface 139 that has a downwardly and outwardly tapered edge portion at an outer circumferential edge 132, and each of the plural spacedly arrayed annular rings 136 defines a bottom surface 140 that communicates with the outer circumferential edge 132; and placing a first tile 200 in the substrate in a predetermined position; placing the base portion 102 of the anchor 100 in the substrate and positioning a portion of the base portion 102 under one edge 203 of the placed first tile 200 so that some amount of substrate flows into and through the cut-outs 106 defined in the base portion 102, and an edge portion 203 of the first placed tile 200 is in direct frictional contact with the first 122 or second 123 edge portion of the tile spacer 118 carried on the top surface 103 of the base portion 102, and so that the anchor column extension 141 extends vertically upwardly immediately adjacent the edge 203 of the first placed tile 200; placing a second tile 200 in the substrate immediately adjacent the opposing edge portion of the tile spacer 118 carried on the top surface 103 of the base portion 102 of the anchor 100 that was previously placed in the substrate, and at least partially underneath the edge 203 of the first placed tile 200, and aligning the second tile 200 immediately adjacent the tile spacer 118 so that the thickness dimension 119 provided by the tile spacer 118 is the spacing between the first placed tile 200 and the second placed tile 200, and so that the anchor column extension 141 extends vertically upwardly from the space between the first and second placed tiles 200; providing a mid-plate 80 that is cup-like in configuration and has a body 93 that has a top portion 81 that defines a peripheral edge 95, a bottom portion 82, an outer circumferential surface 83 that defines an outer diameter 87 and plural spacedly arrayed through notches 84 that communicate with the peripheral edge 95 at the top portion 81, and the body 93 defines an interior cavity 85 that has an opening orifice 86 at the top portion 81 and a closed bottom portion 94 within the interior cavity 85 opposite the opening orifice 86, and radially outwardly extending engagement tabs 88 are carried on the outer circumferential surface 83 at the peripheral edge 95 adjacent the opening orifice 86, and the engagement tabs 88 are spacedly arrayed about the peripheral edge 95, and an axially aligned boss 91 is carried on an upper surface of the closed bottom 94 within the interior cavity 85, and an axially aligned through hole 89 is defined in the axially aligned boss 91 and in the closed bottom portion 94 so that the anchor column 131 of the anchor 100 may pass axially therethrough, and the axially aligned hole 89 further defines an axis 92, and a diameter 90; and providing a compression spring 70 which is a coil spring and has a top portion 71, a bottom portion 72, an exterior diameter 74, a length dimension 76 between the top portion 71 and the bottom portion 72, and the coils define a medial channel 73 that has an interior diameter 75, and the compression spring 70 is carried within the interior cavity 85 of the mid-plate 80 and the bottom portion 72 of the compression spring 70 frictionally rests upon the closed bottom portion 94 of the mid-plate 80, and the axially aligned boss 91 of the mid-plate 80 is positioned within the medial channel 73 defined by the compression spring 70; and providing a leveling base 10 that is axially movably interconnected with the mid-plate 80 and adjustably engages, in only one direction, with the anchor column 131 and the plural spaced annular rings 136 of the anchor 100, and the leveling base 10 has a body 11 that has an inverted cup-like configuration with a closed top portion 12, an open bottom portion 13, an outer circumferential surface 14 that has an exterior diameter 16 and which defines plural spacedly arrayed and radially outwardly extending gripping protrusions 15, the body 11 further defines an interior cavity 17 that opens downwardly and has an interior diameter 35 and an interior circumferential surface 18, and the interior circumferential surface 18 defines a recess 19 to engage with the engagement tabs 88 of the mid-plate 80, the body 11 further defines an axially aligned medial through hole 20 in the closed top portion 12, and the axially aligned medial through hole 20 has an axis 36, and an annular sleeve 22 which is axially aligned with the axis 36, is carried by the body 11 inside the interior cavity 17 and the annular sleeve 22 has a first end portion 23 that is structurally attached to an underside of the closed top portion 12 within the interior cavity 17, a second end portion 24, an outer circumferential surface 31 having an exterior diameter 32, and the annular sleeve 22 further defines an axially aligned medial channel 29 extending therethrough, that has an inner circumferential surface 34 and an inner diameter 33, and the axially aligned medial channel 29 has a length 25 that extends from the first end portion 23 to the second end portion 24, and the axially aligned medial channel 29 has an axis 26 which is axially aligned with an axis 36 of the medial hole 20 defined in the closed top portion 12, and the medial channel 29 has a radially reduced interior shoulder 30 proximate the second end portion 24, and the annular sleeve 22 further defines an annular pocket 28 at the second end portion 24 for axial engagement with the axially aligned boss 91 carried within the interior cavity of the mid-plate 80; and a toothed disc 60 formed of a metal is carried within the axially aligned medial channel 22 and frictionally rests upon the radially reduced interior shoulder 30, the toothed disc 60 having, a generally annular configuration with an outer circumferential edge 69, a top surface 61, a bottom surface 62, an exterior diameter 63, and an axially aligned medial hole 64 that has a diameter 66 and a peripheral edge 68, and plural teeth 65 are carried by and extend generally radially inwardly from the peripheral edge 68 of the medial hole 64, and each of the plural teeth 65 has a tip portion 67, and diametrically opposed tip portions 67 of the teeth is 65 of the toothed disc 80 define a passage 59 for the anchor column 131 and at least a number of the plural spaced annular rings 136 carried thereon to pass therethrough in only one direction; and a tapered leveling base insert 40 which has a generally tubular configuration, is fixedly carried within the medial channel 29 defined by the annular sleeve 22 of the leveling base 10, and the tapered leveling base insert 40 is immediately adjacent the top surface 61 of the toothed disc 60 and positionally secures the toothed disc 60 immediately adjacent the radially reduced interior shoulder 30, the tapered leveling base insert 40 has a first end portion 41, a second end portion 42, an outer circumferential surface 43 that defines an exterior diameter 45, a length 44 defined between the first end portion 41 and the second end portion 42, and defines an axially aligned medial channel 46 that extends between the first end portion 41 and the second end portion 42, and the axially aligned medial channel 46 has a major diameter 47, and plural elongate and spacedly arrayed radially inwardly extending vanes 48 are carried within the axially aligned medial channel 46, and a minor diameter 49 of the axially aligned medial channel 46 is defined between diametrically opposed and proximate radially inwardly extending vanes 48, and radially inward edge portions 50 of the radially inwardly extending vanes 48 operatively communicate with the anchor column 131 and the plurality of annular rings 136 to guide axial movement of the anchor column 131 within the medial channel 46; and wherein the compression spring 70 top portion 71 operatively frictionally communicates with an underside of the closed top portion 12 of the leveling base 10, and the compression spring 70 bottom portion 72 operatively frictionally communicates with an upwardly facing surface of the closed bottom portion 94 of the mid-plate 80, and because an uncompressed length dimension 76 of the compression spring is greater than the length dimension 25 of the annular sleeve 22, the compression spring 70 positionally biases the leveling base body 11 axially away from/distally from the mid-plate 80 to an axially extended position where the engagement tabs 88 carried by the mid-plate 80 and which are engaged within the tab recesses 19 defined in the interior circumferential surface 18 of the interior cavity 17 prevent the mid-plate 80 from disengaging from the leveling base 10, and the compression spring 70 is axially positionally secured within the interior cavity 17 by the annular sleeve 20 which is positioned within the medial channel 73 defined by the compression spring 70 coils; and positioning the bottom portion 82 of the mid-plate 80 adjacent above the beveled top end portion 133 of the anchor column 131 so that the axially aligned hole 89 defined in the bottom portion 82 of the mid-plate 80 is coaxially aligned with the axis 135 of the anchor column 131, and axially slidably engaging the mid-plate 80, the attached leveling base 10 and the enclosed toothed disc 60 onto the anchor column 131 and annular rings 136, and moving the leveling base 10 and mid-plate 80 axially downwardly along the anchor column 131 responsively driving a portion of the length 149 of the anchor column 131 and a number of the plurality of spaced annular rings 136 thereon through the medial hole 64 of the toothed disc 60 until the bottom portion 82 of the mid-plate 80 frictionally contacts the top surface 201 of both the first and second placed tiles 200; and exerting an additional axial downward force upon the closed top portion 12 of the leveling base 10 so as to overcome the biasing of the compression spring 70 and to force of the leveling base 10 axially downwardly into closer proximity with the mid-plate 80 which responsively forces the anchor column 131 and a number of the plurality of spacedly arrayed annular rings 136 thereon axially upwardly through the axially aligned medial hole 64 defined in the toothed disc 60 and wherein some number of the plurality of spaced annular rings 136 carried on the anchor column 131 pass through the axially aligned medial hole 64 defined in the toothed disc 60, and the tip portions 67 of the plural teeth 65 frictionally engage with the bottom surface 40 of the plurality of spaced annular rings 136 to positionally secure the leveling base 10, the mid-plate 80 and the anchor 100 at a predetermined distance from one another, and the simultaneous frictional engagement of the bottom portion 82 of the mid-plate 80, and the continuous spring biasing provided by the compression spring 70 move and positionally maintain the two previously placed adjacent tiles 200 in a co-planar orientation; and allowing an amount of time to pass to allow the substrate to harden/cure and to positionally secure the first and second placed tiles 200 in the substrate; and then intentionally striking the leveling base 10 outer circumferential surface 14 with an oblique blow sufficient to cause the anchor column 131 to breakable/destructively separate from the base portion 102 at the frangible interconnection 148 along the length 150 of the anchor column extension 141, permanently leaving the base portion 102 in the hardened/cured substrate below the adjacent placed tiles 200; and providing and placing grout in the space between the first and second placed tiles 200 to fill the space and cover any portion of the anchor column extension 141 remaining between the first and second placed tiles 200; and removing the separated anchor column 131 from the toothed disc 60 within the leveling base 10 and mid-plate so that the leveling base 10 and mid-plate 80 may be reused.

These and other aspects of my invention will be discussed in greater detail hereinafter.

BRIEF DESCRIPTION OF THE DRAWINGS

Preferred embodiments of the present invention are described below with reference to the following accompanying drawings.

FIG. 98 is a downward looking plan view of the toothed disc of FIG. 9A.

DETAILED DESCRIPTION OF THE PREFERRED EMBODIMENTS

Figure 1:
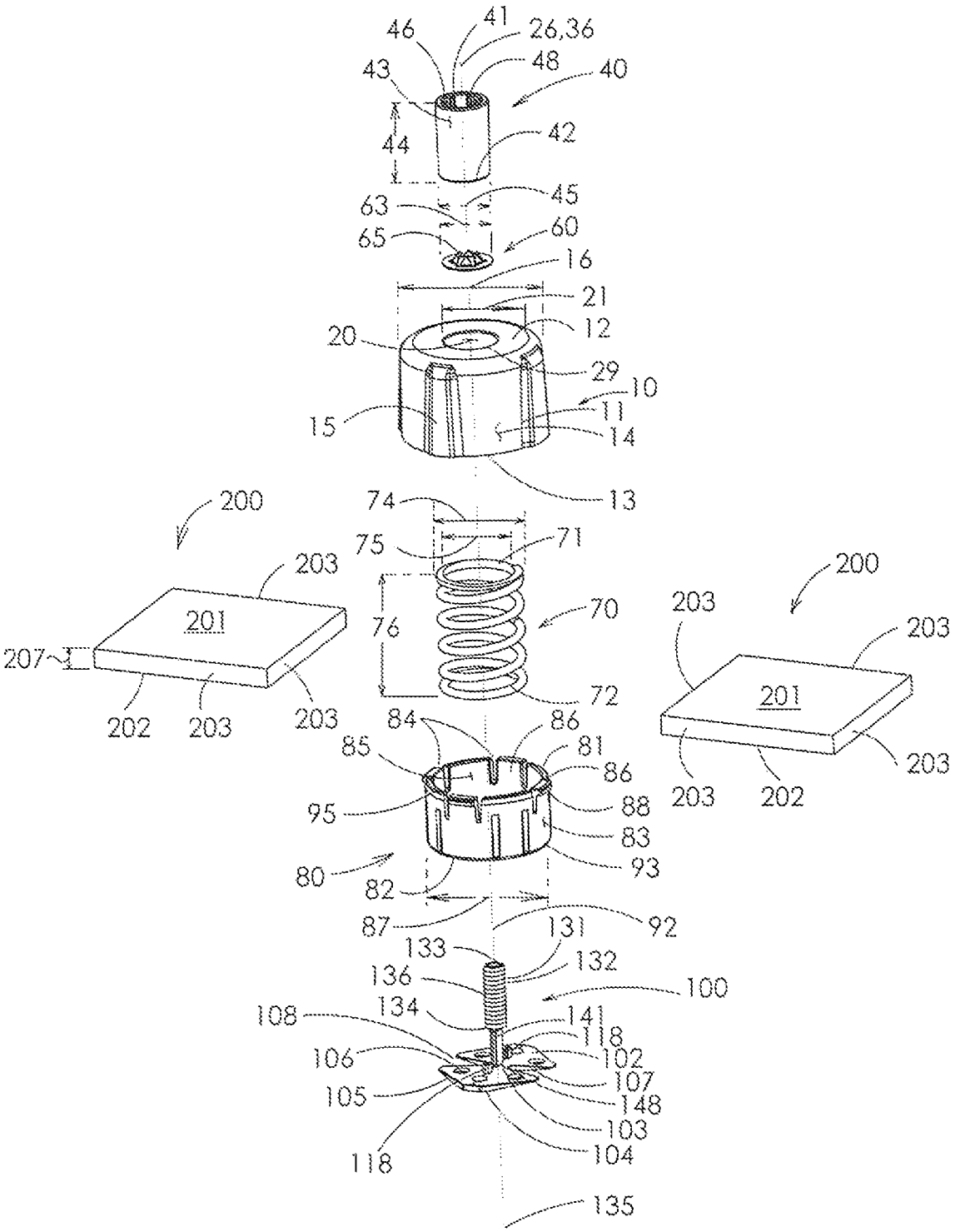
FIG. 1 is a perspective exploded view of the tile leveling and tile spacing apparatus.
Figure 2:
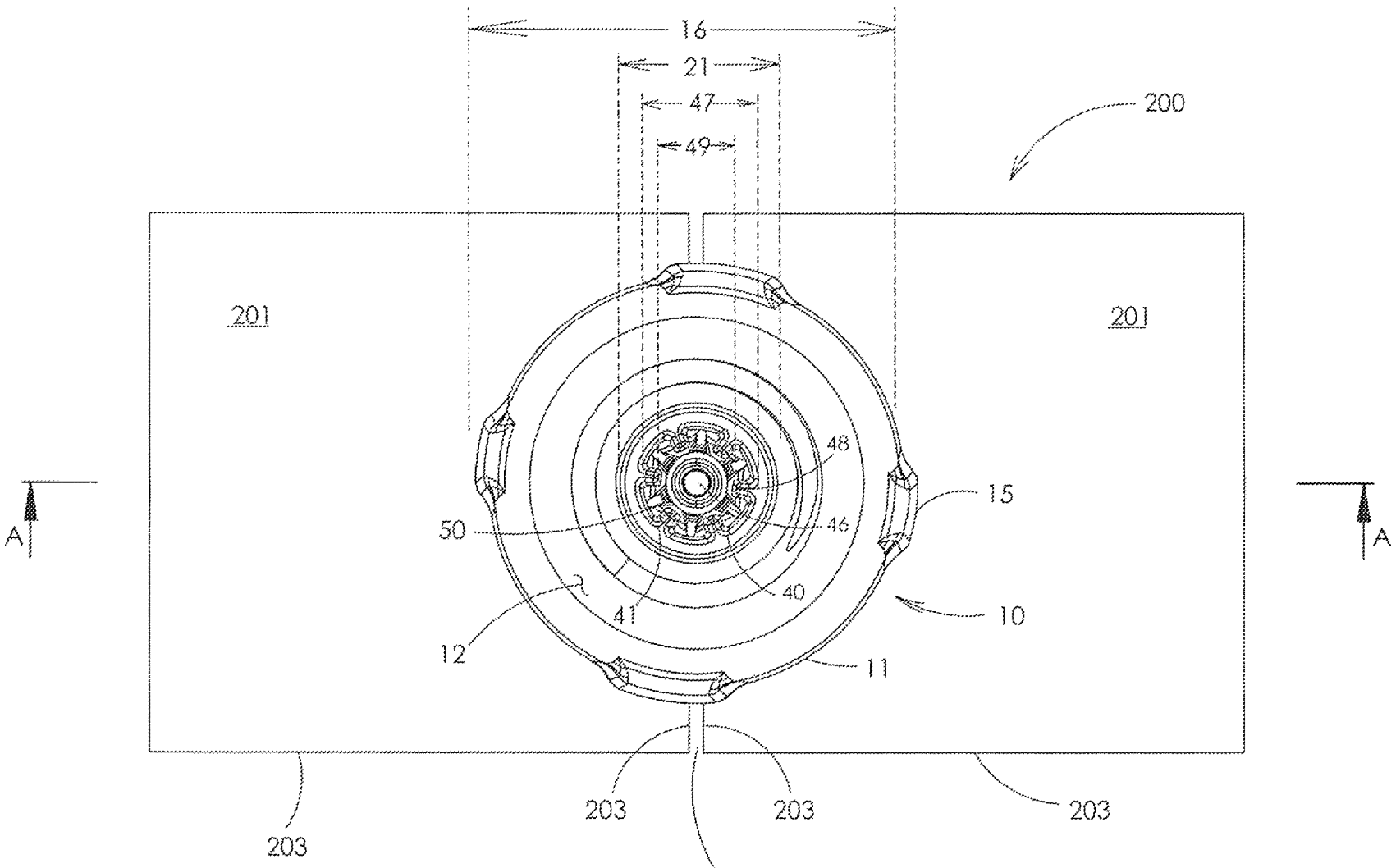
FIG. 2 is a downward looking plan view of the tile leveling and tile spacing apparatus.

This disclosure of the invention is submitted in furtherance of the Constitutional purposes of the U.S. Patent Laws "to promote the progress of science and useful arts (Article I, Section 8).

The present invention relates to a device, a system, and a method for accurately controlling tile lippage and accurately controlling tile spacing during the installation of tiles on a supporting surface. The invention generally provides an anchor 100 and a leveling base 10 that are one-way axially slidably engageable with one another.

The anchor 100 (FIGS. 6A-8B) is a unitary/one-piece structure and generally provides a base portion 102 and an anchor column 131 and an anchor column extension 141 between the anchor column 131 and the base portion 102.

The base portion 102 is substantially planar, and may be, for example only and without limitation, orthogonally shaped or disc shaped. The base portion 102 has a top surface 103, a bottom surface 104, a peripheral edge 105 extending thereabout, and a plurality of spacedly arrayed through cutouts 106 are defined in the base portion 102 and communicate between the top surface 103 and the bottom surface 104. A plurality of tile spacers 118 are carried on the top surface 103 and the plurality of tile spacers 118 extend generally vertically upwardly therefrom. Each of the tile spacers 118 has a top end portion and a predetermined height dimension 121 between the top end portion and the top surface 103 of the base portion 102. Each of the plurality of tile spacers 118 further has a predetermined a thickness dimension 119 between a first side 122 and a second side 123. The predetermined height dimension 121 and the predetermined thickness dimension 119 may be varied/altered as desired (such as during manufacture or thereafter) to provide a desired spacing/gap/joint/seam between adjacent tiles 200, and to accommodate differing thicknesses of tiles 200. Each of the plurality of tile spacers 118 still further has a predetermined position relative to the others of the plurality tile spacers 118 on the top surface 103 of the base portion 102 so that the plurality of tile spacers 118 are spacedly arrayed in a predetermined pattern, to facilitate formation of a desired configuration/spacing/gap/joint/seam between adjacent tiles 200. (For example only, and without limitation, a four corner configuration, FIGS. 8A, 88; a linear/straight configuration, FIGS. 6A, 6B; a "T" configuration, FIGS. 7A, 7B). These described configurations are shown as examples only, and are not limiting. Other predetermined configurations are likewise contemplated herein. The base portion 102 has a draw to facilitate the molding process.

Figure 6A:
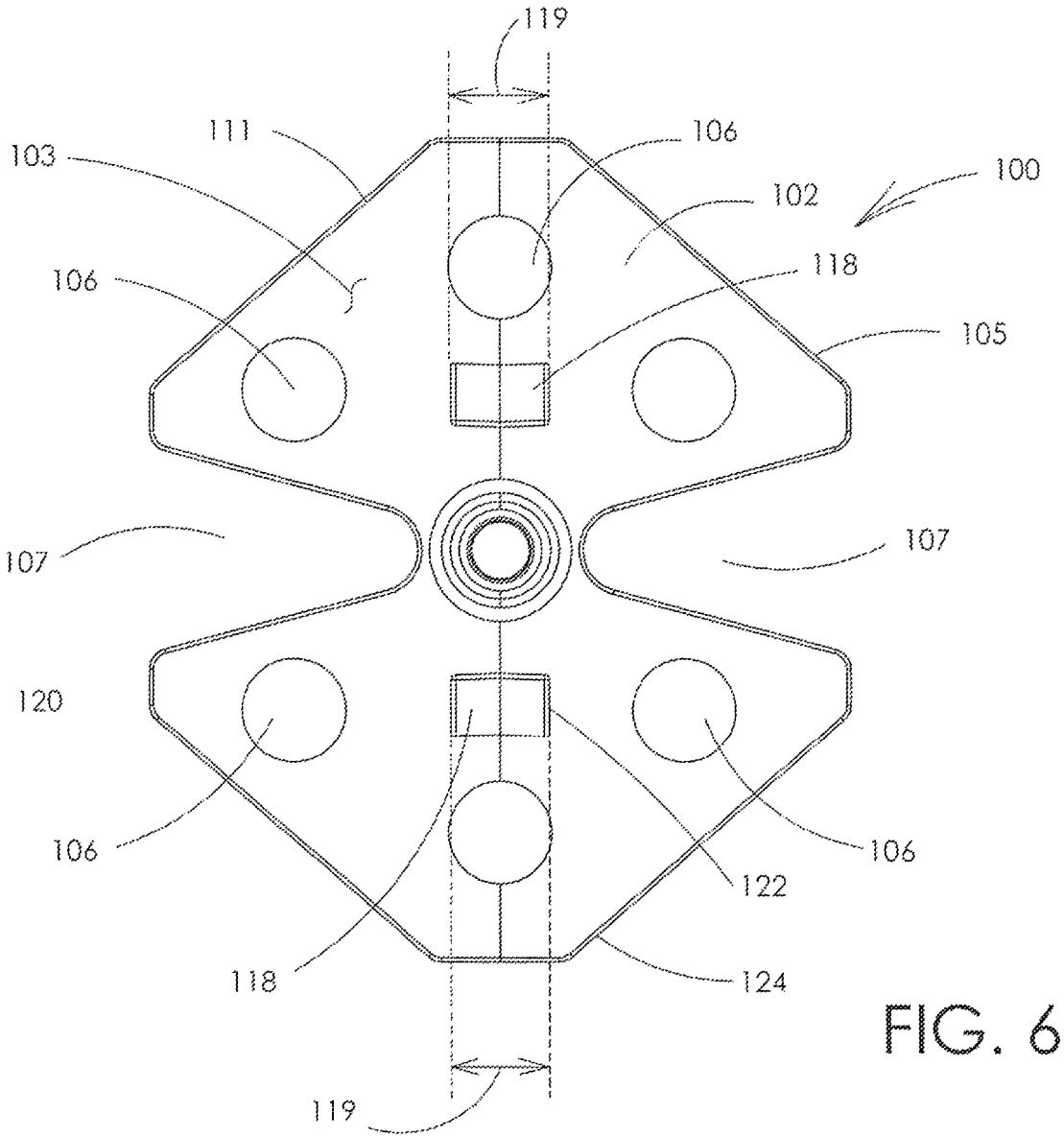
FIG. 6A is an enlarged downward looking plan view of an anchor configured for a linear/straight grout joint.
Figure 6B:
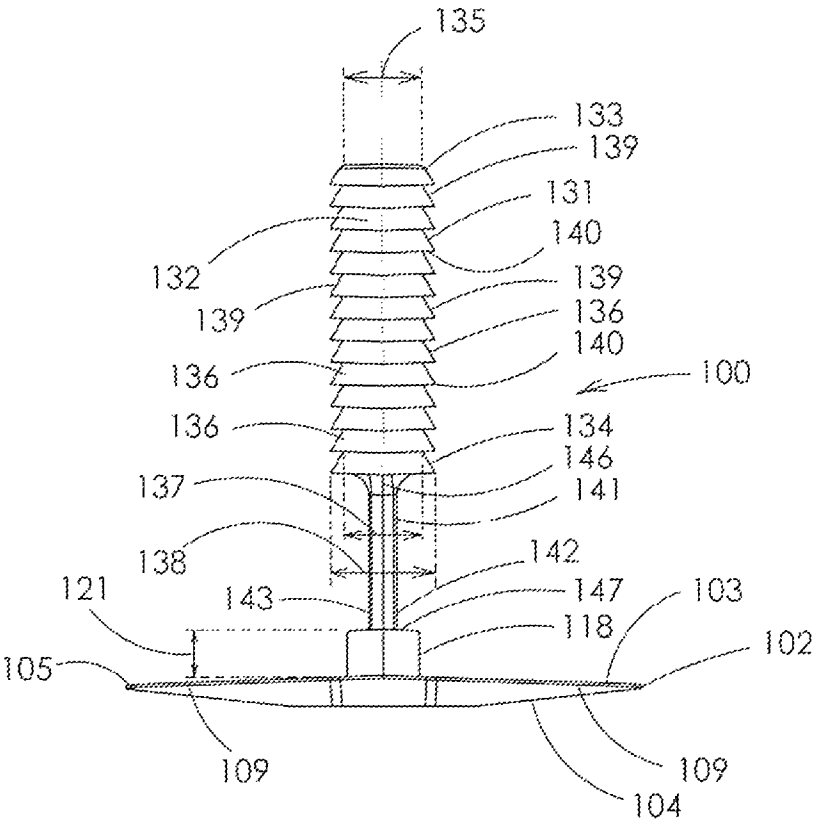
FIG. 6B is an orthographic side view of the anchor of FIG. 6A.
Figure 7A:
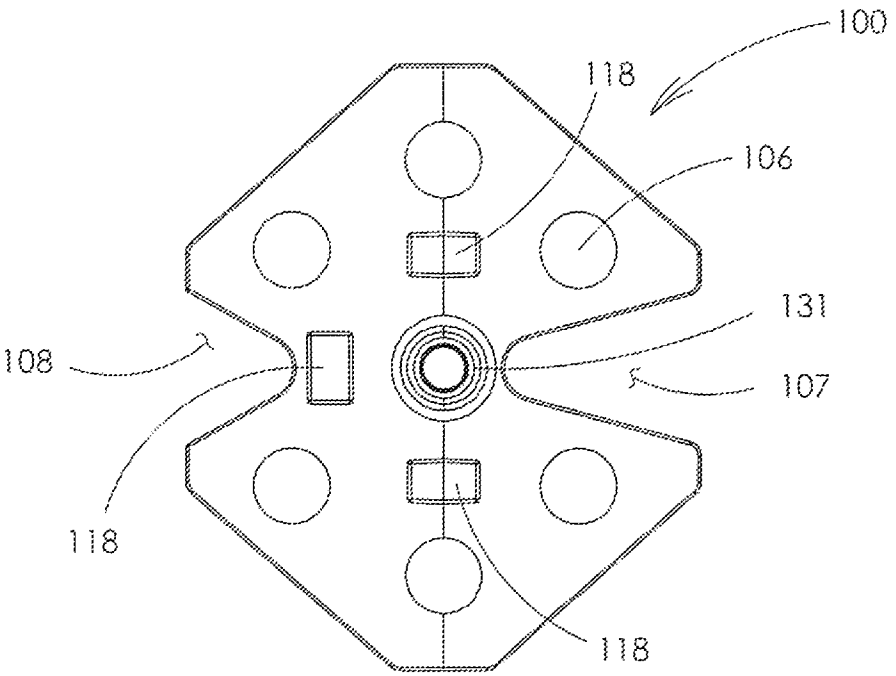
FIG. 7A is an enlarged downward looking plan view of an anchor configured for a "T" shaped grout joint.
Figure 7B:
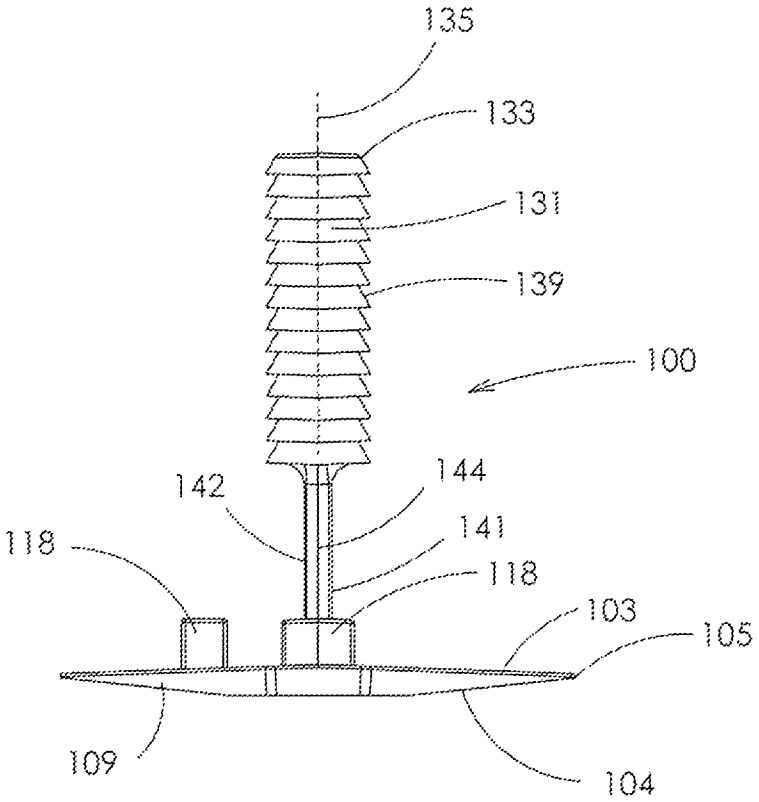
FIG. 7B is an orthographic side view of the anchor of FIG. 7A.
Figure 8A:
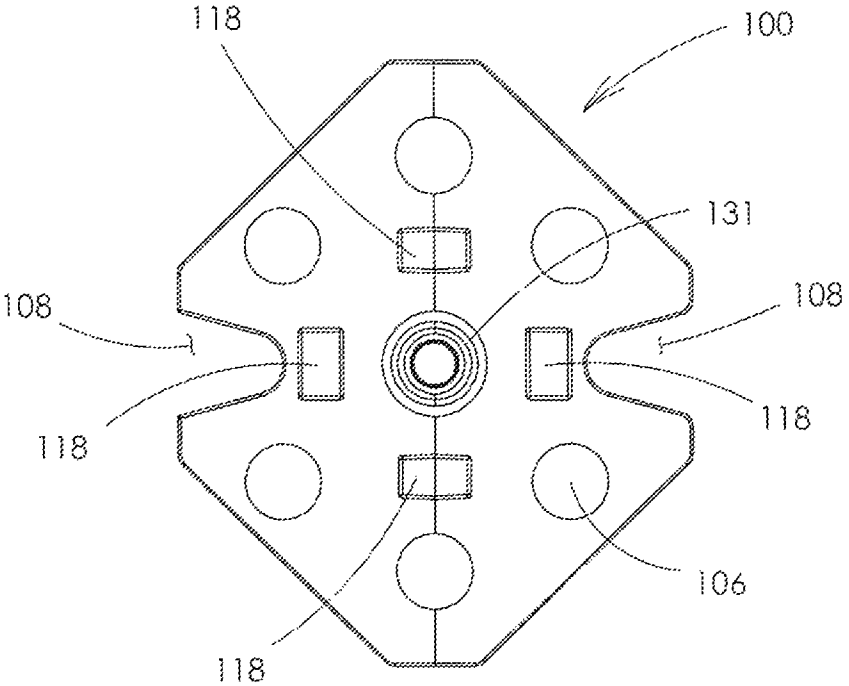
FIG. 8A is an enlarged downward looking plan view of an anchor configured for a "4-corner" grout joint.
Figure 8B:
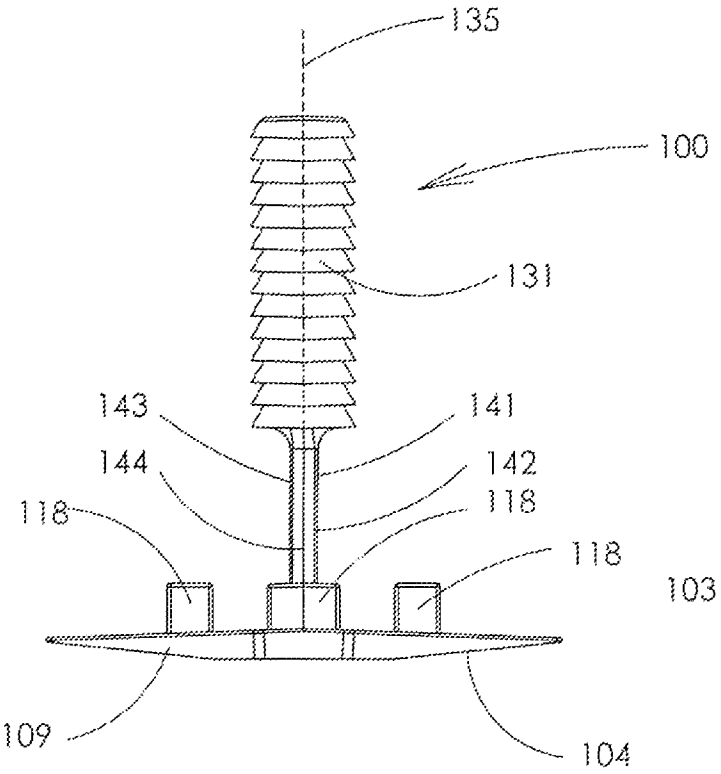
FIG. 8B is an orthographic side view of the anchor of FIG. 8A.

As shown in FIGS. 6A, 7A and 8A, the base portion 102 defines cut outs 107, 108 that may be generally triangular in configuration. The particular configuration and size of the cut out 107, 108 is affected by the number, position and orientation of the of tile spacers 118 carried on the top surface 103 of the base portion 102. The cut outs 107, 108 further provide the base portion 102 some independence relative to lifting tiles 200 and accommodating differing thicknesses in tiles 200.

The anchor column 131 is integral with the base portion 102 and is generally cylindrical and elongate and extends generally vertically upwardly from the top surface 103 of the base portion 102. The anchor column 131 has a beveled top end portion 133, a bottom end portion 134, an outer circumferential surface 132 and defines a longitudinal axis 135.

The anchor column extension 141 is generally rectilinear in peripheral configuration and interconnects the anchor column 131 to the top surface 103 of the base portion 102. The anchor column extension 141 has a first end portion 146 that structurally communicates with the bottom end portion 134 of the anchor column 131, and a second end portion 147 that structurally communicates with the top surface 103 of the base portion 102 of the anchor 100. The anchor column extension 141 has a first side 142, a second side 143, a first lateral edge 144 and a second lateral edge 145, and the anchor column extension 141 is designed to fracture/break at a predetermined location 148 between the bottom end portion 134 of the anchor column 131 and the top surface 103 of the base portion 102. The predetermined location 148 for the breakage/fracture is preferably immediately adjacent to, or closely proximate to, the top surface 103 of the base portion 102 of the anchor 100. The predetermined location 148 may be scored, or otherwise intentionally weakened, to facilitate breakage/fracture at the predetermined location 148.

The anchor column 131 is breakably/destructively separable from the base portion 102 generally along the anchor column extension 141 and proximate to the top surface 103 of the base portion 102. A thickness dimension of the anchor column extension 141 between the first side 142 and the second side 143 is equal to, or less than, the thickness dimension 119 of each of the plurality of the tile spacers 118 on the top surface 103 of the base portion 102.

The anchor column 131 of the anchor 100 is substantially cylindrical in configuration and has a beveled top end portion 133, and the bottom end portion 134 of the anchor column 131 structurally communicates with the first end portion 146 of the anchor column extension 141. The anchor column 131 defines a length 149 between the beveled top end portion 133 and the bottom end portion 134, an axis 135, and the anchor column 131 defines plural spacedly arrayed, and circumferentially extending, annular rings 136 along the length 149 of the anchor column 131. Each of the plural spacedly arrayed annular rings 136 defines a minor diameter 137 and a major diameter 138, and each of the plural spacedly arrayed annular rings 136 defines an upper surface 139 that has a downwardly and outwardly tapered edge portion at an outer circumferential edge 132. Each of the plural spacedly arrayed annular rings 136 further defines a bottom surface 140 that communicates with the outer circumferential edge 132.

Figure 3:
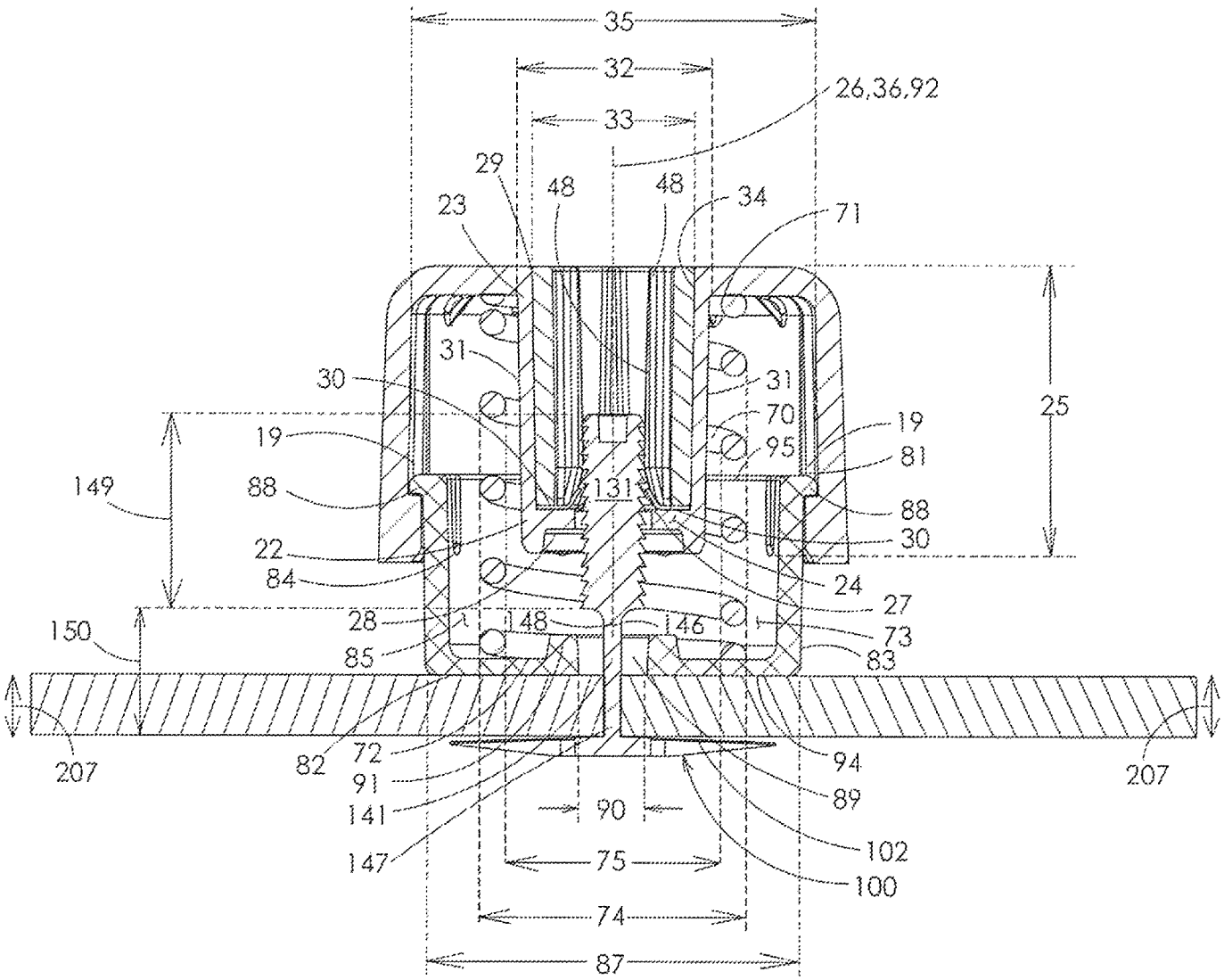
FIG. 3 is a cross section view of the tile leveling and tile spacing apparatus of FIG. 2, taken on line A-A of FIG. 2, showing the tile leveling and tiling spacing apparatus in a non-compressed state.
Figure 4:
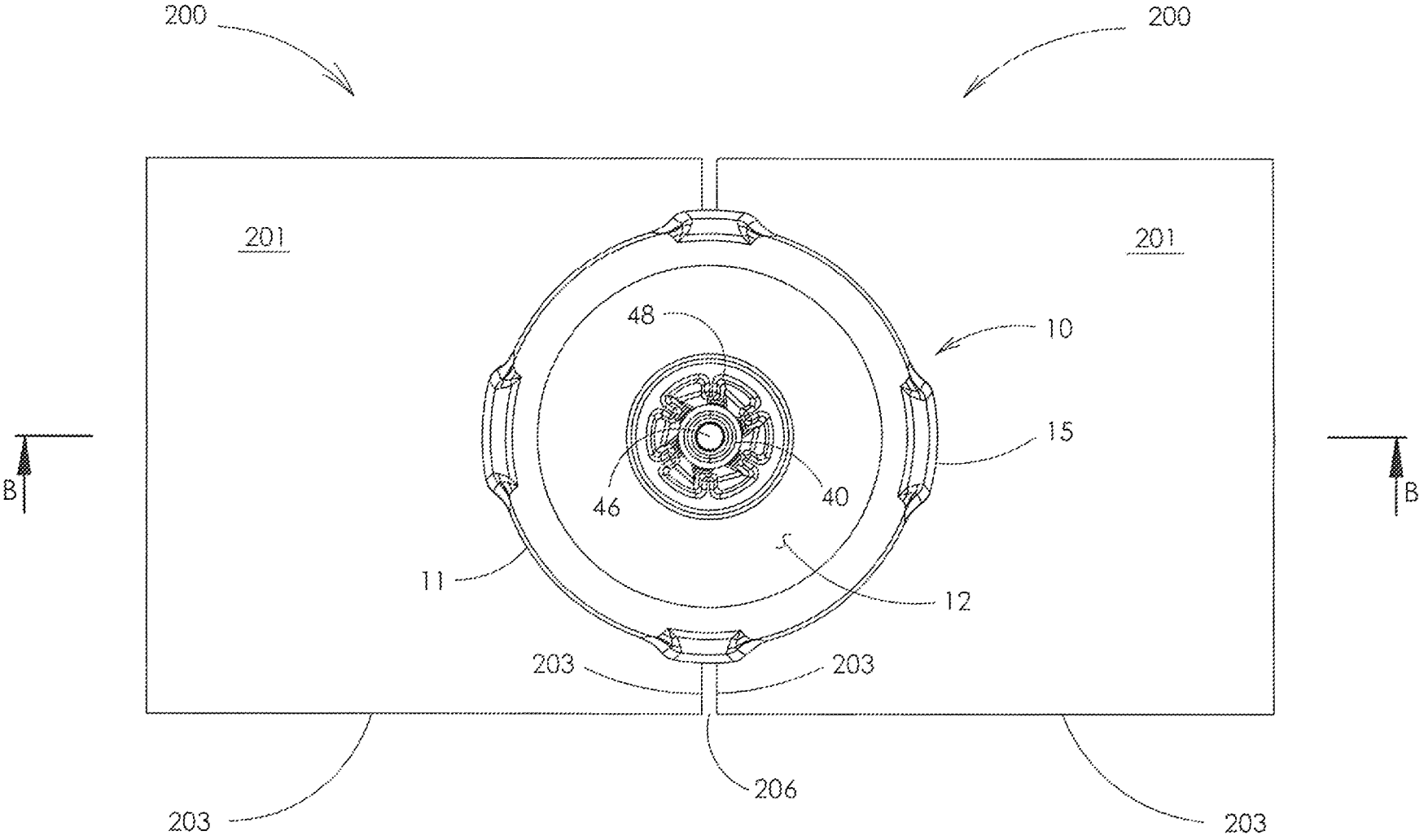
FIG. 4 is a downward looking plan view of the tile leveling and tile spacing apparatus, similar to that of FIG. 2.
Figure 5:
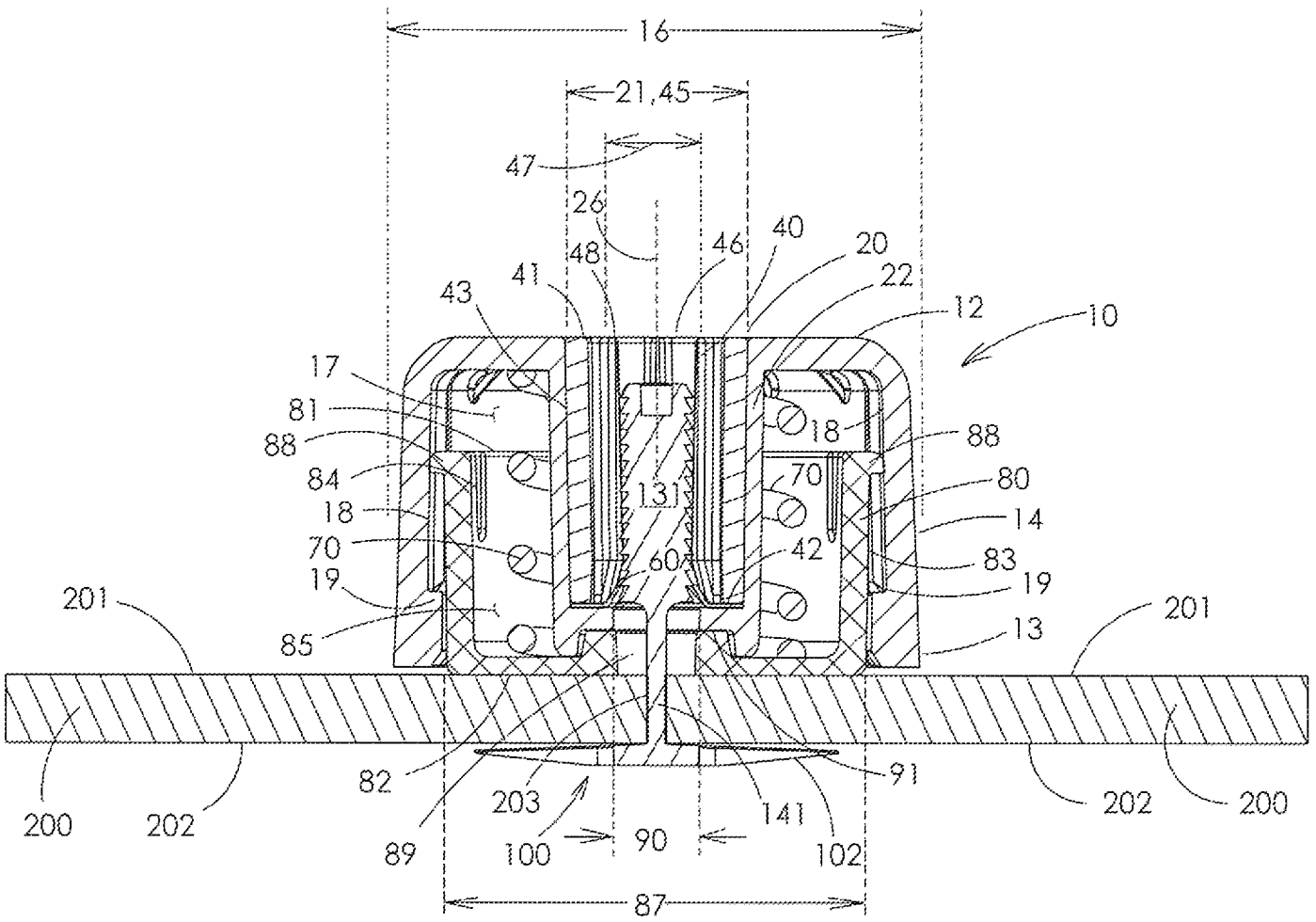
FIG. 5 is a cross section view of the tile leveling and tile spacing apparatus of FIG. 4, taken on line B-B of FIG. 4, showing the tile leveling and tile spacing apparatus in a compressed state.

The leveling base 10 is best shown in FIGS. 1, 3 and 5. The leveling base 10 has a tapered leveling base insert 40, a toothed disc 60, a compression spring 70 and a mid-plate 80.

Best shown in FIG. 1, the mid-plate 80 is cup-like in configuration and has a body 93 that has a top portion 81 that defines a peripheral edge 95, a bottom portion 82, an outer circumferential surface 83 that defines an outer diameter 87 and plural spacedly arrayed through notches 84 that communicate with the peripheral edge 95 at the top portion 81. The body 93 defines an interior cavity 85 that has an opening orifice 86 at the top portion 81 and a closed bottom portion 94 within the interior cavity 85 opposite the opening orifice 86. Radially outwardly extending engagement tabs 88 are spacedly arrayed about the outer circumferential surface 83 at the peripheral edge 95 adjacent the opening orifice 86. The radially outwardly extending engagement tabs 88 are positioned between adjacent through notches 84. An axially aligned boss 91 is carried on an upper surface of the closed bottom 94 within the interior cavity 85, and an axially aligned through hole 89 is defined in both the axially aligned boss 91 and in the closed bottom portion 94 so that the anchor column 131 of the anchor 100 may pass axially therethrough. The axially aligned hole 89 further defines an axis 92, and a diameter 90.

The compression spring 70 (FIG. 1) is a coil spring formed of metal, such as, but not limited to stainless steel, high carbon steel, or plated high carbon steel, and has a top portion 71, a bottom portion 72, an exterior diameter 74, a length dimension 76 between the top portion 71 and the bottom portion 72, and the coils define a medial channel 73 that has an interior diameter 75. The compression spring 70 is carried within the interior cavity 85 of the mid-plate 80 and the bottom portion 72 of the compression spring 70 operatively frictionally rests upon the closed bottom portion 94 of the mid-plate 80. The axially aligned boss 91 of the mid-plate 80 is positioned within the medial channel 73 defined by the compression spring 70.

Best shown in FIGS. 1, 3 and 5, the leveling base 10 is axially movably interconnected with the mid-plate 80 and adjustably engages, in only one direction, with the anchor column 131 of the anchor 100.

The leveling base 10 has a body 11 that has an inverted cup-like configuration. The body 11 has a closed top portion 12, an open bottom portion 13, an outer circumferential surface 14 that has an exterior diameter 16 and which defines plural spacedly arrayed and radially outwardly extending gripping protrusions 15. The body 11 further defines an interior cavity 17 that opens downwardly and has an interior diameter 35 and an interior circumferential surface 18. The interior circumferential surface 18 defines a recess 19 (preferably plural spacedly arrayed recesses 19) to engage with the engagement tabs 88 of the mid-plate 80. The body 11 further defines an axially aligned medial through hole 20 in the closed top portion 12, and the axially aligned medial through hole 20 has an axis 36.

An annular sleeve 22 (FIGS. 3 and 5) which is axially aligned with the axis 36 of the medial through hole 20 is carried by the body 11 inside the interior cavity 17. The annular sleeve 22 has a first end portion 23 that is structurally interconnected to an underside of the closed top portion 12 within the interior cavity 17, a second end portion 24, and an outer circumferential surface 31 having an exterior diameter 32. The annular sleeve 22 further defines an axially aligned medial channel 29 extending therethrough. The axially aligned medial channel 29 has an inner circumferential surface 34 and an inner diameter 33, and the axially aligned medial channel 29 has a length 25 that extends from the first end portion 23 to the second end portion 24. The axially aligned medial channel 29 defines an axis 26 which is axially aligned with an axis 36 of the medial hole 20 defined in the closed top portion 12. The axially aligned medial channel 29 further has a radially reduced interior shoulder 30 proximate the second end portion 24, and the axially aligned annular sleeve 22 further defines an annular pocket 28 at the second end portion 24 for axial engagement with the axially aligned boss 91 carried within the interior cavity of the mid-plate 80. Engagement of the axially aligned boss 91 in the annular pocket 28 limits axial movement of the leveling base 10 relative to the mid-plate 80.

Figure 9A:
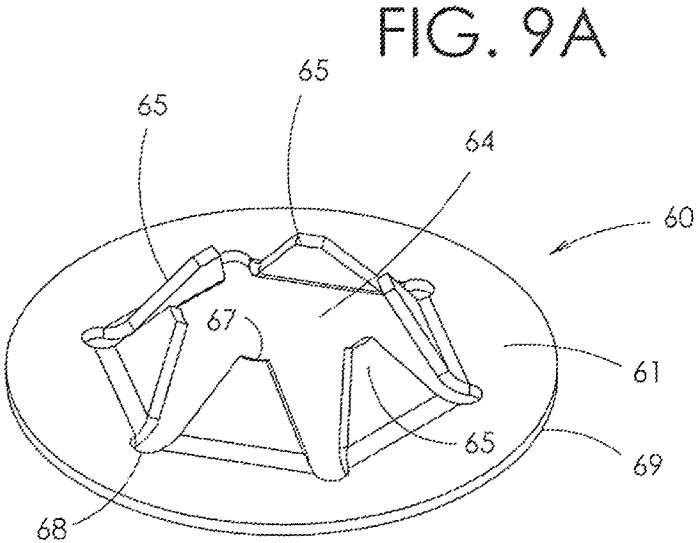
FIG. 9A is an enlarged perspective view of the toothed disc.
Figure 9B:
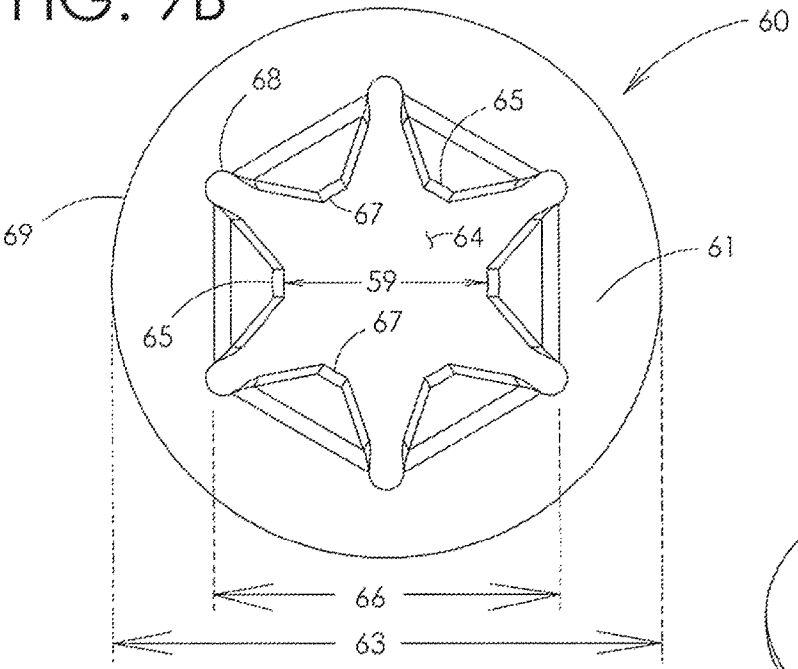
FIG. 9C is an orthographic side view of the toothed disc of FIG. 9A.
Figure 9C:
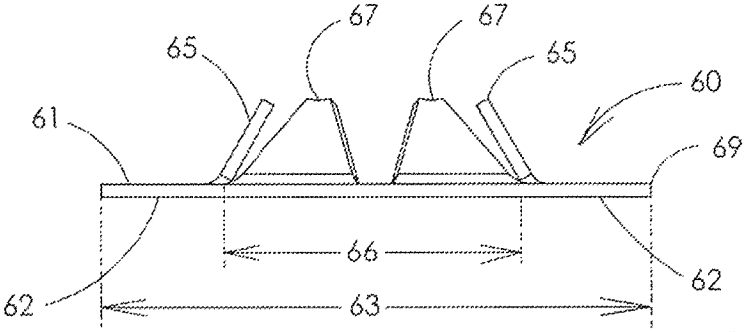

A toothed disc 60 formed of a metal (such as, but not limited to spring steel) is carried within the axially aligned medial channel 29 and frictionally rests upon the radially reduced interior shoulder 30 of the annular sleeve 22. Best shown in FIGS. 9A, 9B and 9C, the toothed disc 60 has, an annular configuration with an outer circumferential edge 69, a top surface 61, a bottom surface 62, an exterior diameter 63, and an axially aligned medial hole 64 that has a diameter 66 and an peripheral edge 68. Plural teeth 65 are carried by and extend generally radially inwardly from the peripheral edge 68 of the medial hole 64. Each of the plural teeth 65 has a somewhat pointed tip portion 67, and terminal ends of the diametrically opposed tip portions 67 of the teeth 65 of the toothed disc 80 define a passage 59 for a portion of the length of the anchor column 131 and a number of the plural spaced annular rings 136 carried thereon, to pass therethrough in only one direction.

A tapered leveling base insert 40 having a generally tubular configuration, is fixedly carried within the medial channel 29 defined by the annular sleeve 22 of the leveling base 10. The tapered leveling base insert 40 is immediately adjacent the top surface 61 of the toothed disc 60 and positionally secures the toothed disc 60 upon the radially reduced interior shoulder 30 of the annular sleeve 22. The leveling base insert 40 has a first end portion 41, a second end portion 42, an outer circumferential surface 43 that defines an exterior diameter 45. A length 44 is defined between the first end portion 41 and the second end portion 42, and an axially aligned medial channel 46 extends between the first end portion 41 and the second end portion 42. The axially aligned medial channel 46 has a major diameter 47, and plural elongate and spacedly arrayed radially inwardly extending vanes 48 are carried within the axially aligned medial channel 46. A minor diameter 49 of the axially aligned medial channel 46 is defined between diametrically opposed and proximate radially inwardly extending vanes 48. Radially inward edge portions 50 of the radially inwardly extending vanes 48 frictionally communicate with the anchor column 131 to guide the axial movement of the anchor column 131 within/through the medial channel 46. Engagement of the tapered leveling base insert 40 within the medial channel 29 defined by the annular sleeve 22 is preferably a friction fit, although it is also contemplated that an adhesive may be used and/or a fastener may be used. The length 44 of the tapered leveling base insert 40 is less than the length of the medial channel 29 defined by the annular sleeve 22.

The compression spring 70 top portion 71 operatively frictionally communicates with an underside of the closed top portion 12 of the leveling base 10, and the bottom portion 72 of the compression spring 70 operatively frictionally communicates with an upwardly facing surface of the closed bottom portion 94 of the mid-plate 80. Because the length dimension 76 of the compression spring is greater than the length dimension 25 of the annular sleeve 22, the compression spring 70 positionally biases the leveling base body 11 axially away from/distally from the mid-plate 80 to an axially extended position (FIG. 3) where the engagement tabs 88 carried by the mid-plate 80 and which are engaged within the tab recesses 19 defined in the interior circumferential surface 18 of the interior cavity 17 prevent the mid-plate 80 from disengaging from the leveling base 10. The compression spring 7 is axially positionally secured within the interior cavity 17 by the annular sleeve 20 and the axially aligned boss 91 which are both positioned within the medial channel 73 defined by the compression spring 70 coils.

Frictional engagement of the plural teeth 65 of the toothed disc 60 with the anchor column 131, and the plurality of spacedly arrayed annular rings 136 thereon, in combination with the biasing of the compression spring 70, draws the base portion 102 of the anchor 100 closer to the bottom portion 82 of the mid-plate 80 which causes tiles 200 that are immediately adjacent the anchor column extension 141 and immediately adjacent the tile spacers 118 and which the base portion 102 of the anchor 100 is underneath, to move into planar linear alignment, and predetermined spaced alignment.

An essential aspect of the present invention is that the anchor column 131 and some number of the plural spacedly arrayed annular rings 136 thereon may pass through the medial hole 64 defined in the toothed disc 60 in only one direction.

The compression spring 70 preferably has a tension of between approximately 30 pounds and 110 pounds, and even more preferably approximately 47 pounds.

Having described the structure of my tile lippage control and tile spacing system, and method therefore, its operation will be briefly described. OPERATION The operation of the described embodiment of the present invention is believed to be readily apparent, and is briefly summarized at this point.

In its broadest aspect the present invention relates to a lippage control and tile spacing system, and method therefore.

More specifically, the present invention relates to a device, system and method for controlling (minimizing) tile lippage during tile installation, and also for consistently controlling spacing between adjacent tiles during installation.

The present inventive method to consistently space a tile 200 a desired distance from another tile 200, and to consistently level adjacent tiles 200 while the tiles 200 are being set in a substrate, so as to form a finished planar surface, comprises the steps:

providing a surface that is at least partially covered with the substrate.

Providing at least two tiles 200 to be placed adjacent one another in the substrate with the desired distance between adjacent edge portions 203 of the at least two tiles 200.

Providing an anchor 100 having an anchor column 131, a base portion 102 and an anchor column extension 141 between the anchor column 131 and the base portion 102 and wherein the base portion 102 of the anchor 100 has a top surface 103, bottom surface 104 that is substantially planar, and a peripheral edge 105 that extends about the base portion 102, and plural spacedly arrayed through cut outs 106 are defined in the base portion 102, and the base portion 102 has a tapering thickness 109 such that a thickness of the base portion 102 is smallest adjacent to the peripheral edge 105, and a tile spacer 118 is carried on the top surface 103 of the base portion 102 and the tile spacer 118 extends generally perpendicularly upwardly therefrom, and the tile spacer 118 defines a thickness dimension 119 between a first side 122 and a second side 123, and a height dimension 121; and the anchor column extension 141 is generally rectilinear in peripheral configuration and interconnects the anchor column 131 to the base portion 102, and the anchor column extension 141 a first end portion 146 structurally communicates with a bottom end portion 134 of the anchor column 131, and the second end portion 147 of the anchor column extension 141 that structurally communicates with the top surface 103 of the base portion 102 of the anchor 100, and the anchor column extension 141 has a first side 142, a second side 143, a first lateral edge 144 and a second lateral edge 145, and the anchor column extension 141 is designed to fracture/break at a location 148 between the bottom end portion 134 of the anchor column 131 and the top surface 103 of the base portion 102, and the anchor column 131 is breakably/destructively separable from the anchor 100 along the anchor column extension 141, and a thickness dimension of the anchor column extension 141 between the first side 142 and the second side 143 is equal to, or less than, the thickness dimension 119 of the tile spacer 118; and the anchor column 131 of the anchor 100 is generally cylindrical in configuration and has a top end portion 133 that is beveled, and the bottom end portion 134 communicates with the first end portion 146 of the anchor column extension 141, the anchor column 131 defines a length 149 between the top end portion 133 and the bottom end portion 134, an axis 135, and the anchor column 131 defines plural spacedly arrayed, and circumferentially extending, annular rings 136 along the length 149 of the anchor column 131, and each of the plural spacedly arrayed annular rings 136 defines a minor diameter 137 and a major diameter 138, and each of the plural spacedly arrayed annular rings 136 defines an upper surface 139 that has a downwardly and outwardly tapered edge portion at an outer circumferential edge 132, and each of the plural spacedly arrayed annular rings 136 defines a bottom surface 140 that communicates with the outer circumferential edge 132.

Placing a first tile 200 in the substrate in a predetermined position.

Placing the base portion 102 of the anchor 100 in the substrate and positioning a portion of the base portion 102 under one edge 203 of the placed first tile 200 so that some amount of substrate flows into and through the cut-outs 106 defined in the base portion 102, and an edge portion 203 of the first placed tile 200 is in direct frictional contact with one edge portion of the tile spacer 118 carried on the top surface 103 of the base portion 102, and so that the anchor column extension 141 extends vertically upwardly adjacent the edge 203 of the first placed tile 200.

Placing a second tile 200 in the substrate immediately adjacent the opposing edge portion of the tile spacer 118 carried on the top surface 103 of the base portion 102 of the anchor 100 that was previously placed in the substrate, and at least partially underneath the edge 203 of the first placed tile 200, and aligning the second tile 200 immediately adjacent the tile spacer 118 so that the thickness dimension 119 provided by the tile spacer 118 is the spacing between the first and second placed tiles 200, and so that the anchor column extension 141 extends vertically upwardly from the space between the first and second placed tiles 200.

Providing a mid-plate 80 and is cup-like in configuration and has a body 93 that has a top portion 81 that defines a peripheral edge 95, a bottom portion 82, an outer circumferential surface 83 that defines an outer diameter 87 and plural spacedly arrayed through notches 84 that communicate with the peripheral edge 95 at the top portion 81, and the body 93 defines an interior cavity 85 that has an opening orifice 86 at the top portion 81 and a closed bottom portion 94 within the interior cavity 85 opposite the opening orifice 86, and radially outwardly extending engagement tabs 88 are carried on the outer circumferential surface 83 at the peripheral edge 95 adjacent the opening orifice 86, and the engagement tabs 88 are positioned between adjacent through notches 84, and an axially aligned boss 91 is carried on an upper surface of the closed bottom 94 within the interior cavity 85, and an axially aligned through hole 89 is defined in both the axially aligned boss 91 and in the closed bottom portion 94 so that the anchor column 131 of the anchor 100 may pass axially therethrough, and the axially aligned hole 89 further defines an axis 92, and a diameter 90.

Providing a compression spring 70 which is a coil spring that has a top portion 71, a bottom portion 72, an exterior diameter 74, a length dimension 76 between the top portion 71 and the bottom portion 72, and the coils define a medial channel 73 that has an interior diameter 75, and the compression spring 70 is carried within the interior cavity 85 of the mid-plate 80 and the bottom portion 72 of the compression spring 70 frictionally rests upon the closed bottom portion 94 of the mid-plate 80, and the axially aligned boss 91 of the mid-plate 80 is positioned within the medial channel 73 defined by the compression spring 70.

Providing a leveling base 10 that is axially movably interconnected with the mid-plate 80 and adjustably engages, in only one direction, with the anchor column 131 of the anchor 100, and the leveling base 10 has, a body 11 having an inverted cup-like configuration with a closed top portion 12, an open bottom portion 13, an outer circumferential surface 14 that has an exterior diameter 16 and which defines plural spacedly arrayed and radially outwardly extending gripping protrusions 15, the body 11 further defines an interior cavity 17 that opens downwardly and has an interior diameter 35 and an interior circumferential surface 18, and the interior circumferential surface 18 defines a recess 19 to engage with the engagement tabs 88 of the mid-plate 80, the body 11 further defines an axially aligned medial through hole 20 in the closed top portion 12, and the axially aligned medial through hole 20 has an axis 36, and an annular sleeve 22 which is axially aligned with the axis 36, is carried by the body 11 inside the interior cavity 17 and the annular sleeve 22 has a first end portion 23 that is structurally interconnected with an underside of the closed top portion 12 within the interior cavity 17, a second end portion 24, an outer circumferential surface 31 having an exterior diameter 32, and the annular sleeve 22 further defines an axially aligned medial channel 29 extending therethrough, that has an inner circumferential surface 34 and an inner diameter 33, and the axially aligned medial channel 29 has a length 25 that extends from the first end portion 23 to the second end portion 24, and the axially aligned medial channel 29 has an axis 26 which is axially aligned with an axis 36 of the medial hole 20 defined in the closed top portion 12, and the medial channel 29 has a radially reduced interior shoulder 30 proximate the second end portion 24, and the annular sleeve 22 further defines an annular pocket 28 at the second end portion 24 for axial engagement with the axially aligned boss 91 carried within the interior cavity of the mid-plate 80.

Providing a toothed disc 60 that is formed of a metal and which is placed within the axially aligned medial channel 22 so as to frictionally rest upon the radially reduced interior shoulder 30, the toothed disc 60 having, a generally annular configuration with an outer circumferential edge 69, a top surface 61, a bottom surface 62, an exterior diameter 63, and an axially aligned medial hole 64 that has a diameter 66 and an peripheral edge 68, and plural teeth 65 are carried by and extend generally radially inwardly from the peripheral edge 68 of the medial hole 64, and each of the plural angulated teeth 65 has a tip portion 67, and diametrically opposed tip portions 67 of the teeth 65 of the toothed disc 80 define a passage 59 for the anchor column 131 and the plural spaced annular rings 136 carried thereon to pass therethrough in only one direction.

Providing a tapered leveling base insert 40 that has a generally tubular configuration, and which is fixedly carried within the medial channel 29 defined by the annular sleeve 22 of the leveling base 10, and the tapered leveling base insert 40 is immediately adjacent the top surface 61 of the toothed disc 60 and positionally secures the toothed disc 60 upon the radially reduced interior shoulder 30. The tapered leveling base insert 40 has a first end portion 41, a second end portion 42, an outer circumferential surface 43 that defines an exterior diameter 45, a length 44 defined between the first end portion 41 and the second end portion 42, and defines an axially aligned medial channel 46 that extends between the first end portion 41 and the second end portion 42, and the axially aligned medial channel 46 has a major diameter 47, and plural elongate and spacedly arrayed radially inwardly extending vanes 48 are carried within the axially aligned medial channel 46, and a minor diameter 49 of the axially aligned medial channel 46 is defined between diametrically opposed and proximate radially inwardly extending vanes 48, and radially inward edge portions 50 of the radially inwardly extending vanes 48 operatively communicate with the anchor column 131 to axially guide movement of the anchor column 131 within and through the medial channel 46.

Placing the compression spring 70 within the interior cavity 85 of the mid-plate 80 and interconnecting the leveling base 10 with the mid-plate 80 so that the compression spring 70 top portion 71 operatively frictionally communicates with an underside of the closed top portion 12 of the leveling base 10, and the compression spring 70 bottom portion 72 operatively frictionally communicates with an upwardly facing surface of the closed bottom portion 94 of the mid-plate 80, and because an uncompressed length dimension 76 of the compression spring is greater than the length dimension 25 of the annular sleeve 22, the compression spring 70 positionally biases the leveling base body 11 axially distally away from the mid-plate 80 to an axially extended position where the engagement tabs 88 carried by the mid-plate 80 and which are engaged within the tab recesses 19 defined in the interior circumferential surface 18 of the interior cavity 17 prevent the mid-plate 80 from disengaging from the leveling base 10, and the compression spring 7 is axially positionally secured within the interior cavity 17 by the annular sleeve 20 which is positioned within the medial channel 73 defined by the compression spring 70 coils.

Positioning the bottom portion 82 of the mid-plate 80 adjacent above the beveled top end portion 133 of the anchor column 131 so that the axially aligned hole 89 defined in the bottom portion 82 of the mid-plate 80 is coaxially aligned with the axis 135 of the anchor column 131, and axially slidably engaging the mid-plate 80, the attached leveling base 10 and the enclosed toothed disc 60 onto the anchor column 131, and moving the leveling base 10 and mid-plate 80 axially downwardly along the anchor column 131 until the bottom portion 82 of the mid-plate 80 frictionally contacts the top surface 201 of both the first and second placed tiles 200.

Exerting an additional axial downward force upon the closed top portion 12 of the leveling base 10 so as to compress the compression spring 70 and to force the leveling base 10 axially downwardly into closer proximity with the mid-plate 80 which responsively draws the anchor column 131 axially upwardly through the axially aligned medial hole 64 defined in the toothed disc 60 and wherein some number of the plurality of spaced annular rings 136 carried on the anchor column 131 pass through the axially aligned medial hole 64 defined in the toothed disc 60, and the tip portions 67 of the plural teeth 65 frictionally engage with the anchor column 131 generally between the plurality of spaced annular rings 136 to positionally secure the leveling base 10, the mid-plate 80 and the anchor 100 at a predetermined distance from one another, and the simultaneous frictional engagement of the bottom portion 82 of the mid-plate 80, and the continuous spring biasing provided by the compression spring 70 move and positionally maintain the two previously placed adjacent tiles 200 into a planar orientation. The leveling base 10 is not rotated axially, nor moved laterally relative to the underlying tiles 200 so that lateral forces are not exerted upon the underlying tiles 200 and the underlying tiles 200 are not scratched by movement/rotation of the midplate 80 on the exposed surface of the tile 200.

Allowing an amount of time to pass to allow the substrate to harden/cure and to positionally secure the first and second placed tiles 200 in the substrate.

Intentionally striking the leveling base 10 outer circumferential surface 14 with a blow sufficient to cause the anchor column 131 to breakably/destructively separate from the base portion 102 at the frangible/breakable location 148 along the length 150 of the anchor column extension 141 proximate the top surface 103 of the base portion 102, and permanently leaving the base portion 102 in the hardened/cured substrate below the adjacent placed tiles 200.

Providing and placing grout in the space between the first and second placed tiles 200 to fill the space and cover any portion of the frangible/breakable location 148 remaining between the first and second placed tiles 200.

Removing the separated anchor column 131 from the toothed disc 60 within the leveling base 10 and mid-plate 80 so that the leveling base 10 and mid-plate 80 may be reused.

Therefore, it is shown that the present invention provides a convenient means for avoiding the shortcomings attendant with the prior art tile lippage control and tile spacing devices and systems and methods which have been used, heretofore, in the installation of tiles in the past. The present invention is easy to use, provides consistently uniform results, does not require removal of the tile spacers, and minimizes installation time, and is partially reusable again and again.

In compliance with the statute, my invention has been described in language more or less specific as to structural and methodical features. It is to be understood, however, that the invention is not limited to specific features shown and described since the means herein disclosed comprise preferred forms of putting the invention into effect. The invention is therefore claimed, in any of its forms or modifications, within the proper scope of the appended claims appropriately interpreted in accordance with the doctrine of equivalence.

I claim:

1. A tile leveling and tile spacing apparatus comprising:

an anchor having an anchor column and a base portion and the anchor column is interconnected with and is breakably separable from the base portion, and wherein the anchor column defines plural spaced annular rings along a length of the anchor column; and a leveling base that one way adjustably engages with the anchor column, the leveling base having, a toothed disc that is positionally secured within the leveling base, the toothed disc defining a medial hole with plural radially inwardly angled teeth that frictionally engage with the plural spaced annular rings of the anchor column, and a mid-plate that is carried substantially within an interior cavity defined by the leveling base, and of the mid-plate is movably engaged with the leveling base, and a compression ring that is carried within the interior cavity defined by the leveling base and which communicates with both the leveling base and the mid-plate to positionally bias and space the leveling base away from the mid-plate.

2. The tile leveling and tile spacing apparatus as claimed in claim 1, and further comprising:

a tile spacer on a top surface of the base portion of the anchor, and the tile spacer has a first side portion, a second side portion and a thickness dimension between the first side portion and the second side portion.

3. The tile leveling and tile spacing apparatus as claimed in claim 1, and further comprising:

plural spacedly arrayed tile spacers on a top surface of the base portion of the anchor, and each of the plural spacedly arrayed a tile spacers has a first side portion, a second side portion and a thickness dimension between the first side portion and the second side portion.

4. The tile leveling and tile spacing apparatus as claimed in claim 3, and wherein plural spacedly arrayed tile spacers on a top surface of the base portion of the anchor are configured, relative to one another, and relative to the anchor column, to facilitate a linear tile joint between adjacent edge portions two spacedly adjacent tiles.

5. The tile leveling and tile spacing apparatus as claimed in claim 3, and wherein plural spacedly arrayed tile spacers on a top surface of the base portion of the anchor are configured, relative to one another, and relative to the anchor column, to facilitate a corner "T" joint between adjacent corner and edge portions three spacedly adjacent tiles.

6. The tile leveling and tile spacing apparatus as claimed in claim 3, and wherein plural spacedly arrayed tile spacers on a top surface of the base portion of the anchor are configured, relative to one another, and relative to the anchor column, to facilitate a four-corner joint between adjacent corner edge portions four spacedly adjacent tiles.

7. The tile leveling and tile spacing apparatus as claimed in claim 3, and wherein plural spacedly arrayed tile spacers on a top surface of the base portion of the anchor are configured, relative to one another, and relative to the anchor column, to facilitate a joint between adjacent edge portions plural spacedly adjacent tiles.

8. The tile leveling and tile spacing apparatus as claimed in claim 1, and wherein the mid-plate has a bottom portion that is substantially planar in configuration, and the substantially planar bottom portion frictionally rests upon a generally planar top surface of plural adjacent tiles; and the compression spring, acting upon both the mid-plate, and the leveling base, draws the base portion of the anchor closer to the substantially planar bottom portion of the mid-plate responsively causing the generally planar top surface of the plural adjacent tiles to be planar with one another.

9. The tile leveling and tile spacing apparatus as claimed in claim 1, and wherein the leveling base and the mid-plate are axially movably interconnected with one another, and the compression spring biases the leveling base away from the mid-plate.

10. The tile leveling and tile spacing apparatus as claimed in claim 1, and further comprising:

a medial hole defined in a closed top portion of a body of the leveling base, and the hole defines an axis extending therethrough; and an annular sleeve is carried by a body of the leveling base inside a downwardly opening interior cavity defined by the leveling base body and the annular sleeve has a first end portion that is structurally attached to an underside of the closed top portion of the body within the interior cavity, a second end portion, an outer circumferential surface having an exterior diameter, and the annular sleeve further defines an axially aligned medial channel extending therethrough, that has an inner circumferential surface and an inner diameter, and the axially aligned medial channel has a length that extends from the first end portion to the second end portion, and the axially aligned medial channel has an axis which is axially aligned with the axis of the medial hole defined in the closed top portion, and the medial channel has a radially reduced interior shoulder proximate the second end portion; and a leveling base insert that has a generally tubular configuration, is fixedly carried within the medial channel defined by the annular sleeve of the leveling base, the leveling base insert has a first end portion, a second end portion, an outer circumferential surface that defines an exterior diameter, a length defined between the first end portion and the second end portion, and defines an axially aligned medial channel that extends between the first end portion and the second end portion; and the leveling base insert positionally secures the toothed disc within the medial channel of the annular sleeve and frictionally upon the radially reduced interior shoulder within the medial channel.

11. The tile leveling and tile spacing apparatus as claimed in claim 10, and wherein engagement of the leveling base insert within the medial channel defined by the annular sleeve is a friction fit.

12. The tile leveling and tile spacing apparatus as claimed in claim 10, and wherein engagement of the leveling base insert within the medial channel defined by the annular sleeve is made with an adhesive.

13. The tile leveling and tile spacing apparatus as claimed in claim 10, and wherein engagement of the leveling base insert within the medial channel defined by the annular sleeve is made with a fastener.

14. The tile leveling and tile spacing apparatus as claimed in claim 1, and wherein the anchor column may pass through the medial hole defined in the toothed disc in only one direction.

15. The tile leveling and tile spacing apparatus as claimed in claim 1, and wherein the compression spring has a tension of between approximately 30 pounds and 110 pounds.

16. The tile leveling and tile spacing apparatus as claimed in claim 1, and wherein the compression spring is formed of high carbon spring steel.

17. The tile leveling and tile spacing apparatus as claimed in claim 1, and wherein the compression spring is formed of plated high carbon spring steel.

18. A tile leveling and tile spacing apparatus comprising:

an anchor having an anchor column, an anchor column extension and a base portion opposites the anchor column; and a leveling base having a leveling base insert, a toothed disc, a compression spring and a mid-plate; and wherein the base portion of the anchor has a top surface that is generally planar, bottom surface, and a peripheral edge that extends about the base portion, and plural spacedly arrayed through cut outs are defined in the base portion, and the base portion has a tapering thickness such that a thickness of the base portion is smallest adjacent to the peripheral edge, and a tile spacer is carried on the top surface of the base portion and the tile spacer extends generally perpendicularly upwardly therefrom, and the tile spacer defines a thickness dimension between a first side and a second side, and a height dimension; and the anchor column extension is generally rectilinear in peripheral configuration and interconnects the anchor column to the base portion, and the anchor column extension has a first end portion that structurally communicates with a bottom end portion of the anchor column, and a second end portion that structurally communicates with the top surface of the base portion of the anchor, and the anchor column base has a first side, a second side, a first lateral edge and a second lateral edge, and a frangible interconnection is defined between the bottom end portion of the anchor column and the top surface of the base portion, and the anchor column is breakably/destructively separable from the base portion generally along the anchor column extension, and a thickness dimension of the anchor column extension between the first side and the second side is equal to, or less than, the thickness dimension of the tile spacer; and the anchor column of the anchor is generally cylindrical in configuration and has a top end portion that is beveled, and the bottom end portion communicates with the first end portion of the anchor column extension, the anchor column defines a length between the top end portion and the bottom end portion, an axis, and the anchor column defines plural spacedly arrayed, and circumferentially extending, annular rings along the length of the anchor column, and each of the plural spacedly arrayed annular rings defines a minor diameter and a major diameter, and each of the plural spacedly arrayed annular rings defines an upper downwardly and outwardly tapered edge portion at an outer circumferential edge, and each of the plural spacedly arrayed annular rings defines a horizontal bottom surface that communicates with the outer circumferential edge; and the mid-plate and is cup-like in configuration and has a body that has a top portion that defines a peripheral edge, a bottom portion, an outer circumferential surface that defines an outer diameter and plural spacedly arrayed through notches that communicate with the peripheral edge, and the body defines an interior cavity that has an opening orifice at the top portion and a closed bottom portion within the interior cavity opposite the opening orifice, and radially outwardly extending engagement tabs are carried on the outer circumferential surface at the peripheral edge adjacent the opening orifice, and the engagement tabs are positioned between adjacent through notches, and an axially aligned boss is carried on an upper surface of the closed bottom within the interior cavity, and an axially aligned through hole is defined in the boss and in the closed bottom portion so that the anchor column of the anchor may pass axially therethrough, the axially aligned hole further defines an axis, and a diameter; and the compression spring is a coil spring formed of metal and has a top portion, a bottom portion, an exterior diameter, a length dimension between the top portion and the bottom portion, and the coils define a medial channel that has an interior diameter, and the compression spring is carried within the interior cavity of the mid-plate and the bottom portion of the compression spring frictionally rests upon the closed bottom portion of the mid-plate, and the boss of the mid-plate is positioned within the medial channel defined by the compression spring; and the leveling base is axially movably interconnected with the mid-plate and adjustably engages, in only one direction, with the anchor column of the anchor, and the leveling base has, a body having an inverted cup-like configuration with a closed top portion, an open bottom portion, an outer circumferential surface that has an exterior diameter and which defines plural spacedly arrayed and radially outwardly extending gripping protrusions, the body further defines an interior cavity that opens downwardly and has an interior diameter and an interior circumferential surface, and the interior circumferential surface defines a recess to engage with the engagement tabs of the mid-plate, the body further defines an axially aligned medial through hole in the closed top portion, and the axially aligned medial through hole has an axis, and an annular sleeve which is axially aligned with the axis, is carried by the body inside the interior cavity and the annular sleeve has a first end portion that is structurally attached to an underside of the closed top portion within the interior cavity, a second end portion, an outer circumferential surface having an exterior diameter, and the annular sleeve further defines an axially aligned medial channel extending therethrough, that has an inner circumferential surface and an inner diameter, and the axially aligned medial channel has a length that extends from the first end portion to the second end portion, and the axially aligned medial channel has an axis which is axially aligned with an axis of the medial hole defined in the closed top portion, and the medial channel has a radially reduced interior shoulder proximate the second end portion, and the annular sleeve further defines an annular pocket at the second end portion for axial engagement with the boss carried within the interior cavity of the mid-plate; and a toothed disc formed of a metal is carried within the axially aligned medial channel and frictionally rests upon the radially reduced interior shoulder, the toothed disc having, a generally annular configuration with an outer circumferential edge, a top surface, a bottom surface, an exterior diameter, and an axially aligned medial hole that has a diameter and a peripheral edge, and plural angled teeth are carried by and extend generally radially inwardly and upwardly from the peripheral edge of the medial hole and each of the plural angulated teeth has a tip portion, and diametrically opposed tip portions of the toothed disc define a passage for the anchor column and the plural spaced annular rings carried thereon to pass therethrough in only one direction; and a leveling base insert having a generally tubular configuration, is fixedly carried within the medial channel defined by the annular sleeve of the leveling base, and the leveling base insert is immediately adjacent the top surface of the toothed disc and positionally secures the toothed disc upon the radially reduced interior shoulder, the leveling base insert has a first end portion, a second end portion, an outer circumferential surface that defines an exterior diameter, a length defined between the first end portion and the second end portion, and defines an axially aligned medial channel that extends between the first end portion and the second end portion, and the axially aligned medial channel has a major diameter, and plural elongate and spacedly arrayed radially inwardly extending vanes are carried within the axially aligned medial channel, and a minor diameter of the axially aligned medial channel is defined between diametrically opposed and proximate radially inwardly extending vanes, and radially inward edge portions of the radially inwardly extending vanes frictionally communicate with the anchor column to support and axially guide movement of the anchor column within the medial channel; and the compression spring top portion frictionally communicates with an underside of the closed top portion of the leveling base, and the compression spring bottom portion frictionally communicates with an upwardly facing surface of the closed bottom portion of the mid-plate, and because the length dimension of the compression spring is greater than the length dimension of the annular sleeve, the compression spring positionally biases the leveling base body axially distally from the mid-plate to an axially extended position where the engagement tabs carried by the mid-plate and which are engaged within the tab recesses defined in the interior circumferential surface of the interior cavity prevent the mid-plate from disengaging from the leveling base, and the compression spring is axially positionally secured within the interior cavity by the annular sleeve which is positioned within the medial channel defined by the compression spring coils; and frictional engagement of the plural angulated teeth of the toothed disc with the anchor column and the spacedly arrayed annular rings thereon draws the base portion of the anchor closer to the bottom portion of the mid-plate which causes tiles that are immediately adjacent the anchor column extension and which the base portion of the anchor is underneath to move into planar linear alignment, and predetermined spaced alignment.

19. A method to consistently space a tile a desired distance from another tile, and to consistently level adjacent tiles while the tiles are being set in a substrate, so as to form a finished planar surface, the method comprising the steps:

providing a surface that is at least partially covered with the substrate; providing at least two tiles to be placed adjacent one another in the substrate with the desired distance between adjacent edge portions of the at least two tiles;

providing an anchor having an anchor column, an anchor column extension and a base portion opposites the anchor column; and a leveling base having a leveling base insert, a toothed disc, a compression spring and a mid-plate; and wherein the base portion of the anchor has a top surface that is generally planar, bottom surface, and a peripheral edge that extends about the base portion, and plural spacedly arrayed through cut outs are defined in the base portion, and the base portion has a tapering thickness such that a thickness of the base portion is smallest adjacent to the peripheral edge, and a tile spacer is carried on the top surface of the base portion and the tile spacer extends generally perpendicularly upwardly therefrom, and the tile spacer defines a thickness dimension between a first side and a second side, and a height dimension; and the anchor column extension is generally rectilinear in peripheral configuration and interconnects the anchor column to the base portion, and the anchor column extension has a first end portion that structurally communicates with a bottom end portion of the anchor column, and a second end portion that structurally communicates with the top surface of the base portion of the anchor, and the anchor column base has a first side, a second side, a first lateral edge and a second lateral edge, and a frangible interconnection is defined between the bottom end portion of the anchor column and the top surface of the base portion, and the anchor column is breakably/destructively separable from the base portion generally along the anchor column extension, and a thickness dimension of the anchor column extension between the first side and the second side is equal to, or less than, the thickness dimension of the tile spacer; and the anchor column of the anchor is generally cylindrical in configuration and has a top end portion that is beveled, and the bottom end portion communicates with the first end portion of the anchor column extension, the anchor column defines a length between the top end portion and the bottom end portion, an axis, and the anchor column defines plural spacedly arrayed, and circumferentially extending, annular rings along the length of the anchor column, and each of the plural spacedly arrayed annular rings defines a minor diameter and a major diameter, and each of the plural spacedly arrayed annular rings defines an upper downwardly and outwardly tapered edge portion at an outer circumferential edge, and each of the plural spacedly arrayed annular rings defines a horizontal bottom surface that communicates with the outer circumferential edge; and placing a first tile and the substrate in a predetermined position;

placing the base portion of the anchor in the substrate and positioning a portion of the base portion under one edge of the placed first tile so that some amount of substrate flows into and through the cut outs defined in the base portion, and an edge portion of the first placed tile is in direct frictional contact with one edge portion of the tile spacer carried on the top surface of the base portion, and so that the anchor column extension extends vertically upwardly adjacent the edge of the first placed tile;

placing a second tile in the substrate immediately adjacent the opposing edge portion of the tile spacer carried on the top surface of the base portion of the anchor that was previously placed in the substrate, and at least partially underneath the edge of the first placed tile, and aligning the second tile immediately adjacent the tile spacer so that the thickness dimension provided by the tile spacer is the spacing between the first and second placed tiles, and so that the anchor column extension extends vertically upwardly from the space between the first and second placed tiles;

providing a mid-plate and is cup-like in configuration and has a body that has a top portion that defines a peripheral edge, a bottom portion, an outer circumferential surface that defines an outer diameter and plural spacedly arrayed through notches that communicate with the peripheral edge, and the body defines an interior cavity that has an opening orifice at the top portion and a closed bottom portion within the interior cavity opposite the opening orifice, and radially outwardly extending engagement tabs are carried on the outer circumferential surface at the peripheral edge adjacent the opening orifice, and the engagement tabs are positioned between adjacent through notches, and an axially aligned boss is carried on an upper surface of the closed bottom within the interior cavity, and an axially aligned through hole is defined in the boss and in the closed bottom portion so that the anchor column of the anchor may pass axially therethrough, the axially aligned hole further defines an axis, and a diameter; and providing a compression spring which is a coil spring and has a top portion, a bottom portion, an exterior diameter, a length dimension between the top portion and the bottom portion, and the coils define a medial channel that has an interior diameter, and the compression spring is carried within the interior cavity of the mid-plate and the bottom portion of the compression spring frictionally rests upon the closed bottom portion of the mid-plate, and the boss of the mid-plate is positioned within the medial channel defined by the compression spring; and providing a leveling base that is axially movably interconnected with the mid-plate and adjustably engages, in only one direction, with the anchor column of the anchor, and the leveling base has, a body having an inverted cup-like configuration with a closed top portion, an open bottom portion, an outer circumferential surface that has an exterior diameter and which defines plural spacedly arrayed and radially outwardly extending gripping protrusions, the body further defines an interior cavity that opens downwardly and has an interior diameter and an interior circumferential surface, and the interior circumferential surface defines a recess to engage with the engagement tabs of the mid-plate, the body further defines an axially aligned medial through hole in the closed top portion, and the axially aligned medial through hole has an axis, and an annular sleeve which is axially aligned with the axis, is carried by the body inside the interior cavity and the annular sleeve has a first end portion that is structurally attached to an underside of the closed top portion within the interior cavity, a second end portion, an outer circumferential surface having an exterior diameter, and the annular sleeve further defines an axially aligned medial channel extending therethrough, that has an inner circumferential surface and an inner diameter, and the axially aligned medial channel has a length that extends from the first end portion to the second end portion, and the axially aligned medial channel has an axis which is axially aligned with an axis of the medial hole defined in the closed top portion, and the medial channel has a radially reduced interior shoulder proximate the second end portion, and the annular sleeve further defines an annular pocket at the second end portion for axial engagement with the boss carried within the interior cavity of the mid-plate; and a toothed disc formed of a metal is carried within the axially aligned medial channel and frictionally rests upon the radially reduced interior shoulder, the toothed disc having, a generally annular configuration with an outer circumferential edge 69, a top surface, a bottom surface, an exterior diameter, and an axially aligned medial hole that has a diameter and a peripheral edge, and plural angled teeth are carried by and extend generally radially inwardly and upwardly from the peripheral edge of the medial hole, and each of the plural angulated teeth has a tip portion, and diametrically opposed tip portions of the toothed disc define a passage for the anchor column and the plural spaced annular rings carried thereon to pass therethrough in only one direction; and a leveling base insert having a generally tubular configuration, is fixedly carried within the medial channel defined by the annular sleeve of the leveling base, and the leveling base insert is immediately adjacent the top surface of the toothed disc and positionally secures the toothed disc upon the radially reduced interior shoulder, the leveling base insert has a first end portion, a second end portion, an outer circumferential surface that defines an exterior diameter, a length defined between the first end portion and the second end portion, and defines an axially aligned medial channel that extends between the first end portion and the second end portion, and the axially aligned medial channel has a major diameter, and plural elongate and spacedly arrayed radially inwardly extending vanes are carried within the axially aligned medial channel, and a minor diameter of the axially aligned medial channel is defined between diametrically opposed and proximate radially inwardly extending vanes, and radially inward edge portions of the radially inwardly extending vanes frictionally communicate with the anchor column to support and axially guide movement of the anchor column within the medial channel; and wherein the compression spring top portion frictionally communicates with an underside of the closed top portion of the leveling base, and the compression spring bottom portion frictionally communicates with an upwardly facing surface of the closed bottom portion of the mid-plate, and because an uncompressed length dimension of the compression spring is greater than the length dimension of the annular sleeve, the compression spring positionally biases the leveling base body axially distally from the mid-plate to an axially extended position where the engagement tabs carried by the mid-plate and which are engaged within the tab recesses defined in the interior circumferential surface of the interior cavity prevent the mid-plate from disengaging from the leveling base, and the compression spring is axially positionally secured within the interior cavity by the annular sleeve which is positioned within the medial channel defined by the compression spring coils; and positioning the bottom portion of the mid-plate adjacent above the beveled top end portion of the anchor column so that the axially aligned hole defined in the bottom portion of the mid-plate is coaxially aligned with the axis of the anchor column, and axially slidably engaging the mid-plate, the attached leveling base and the enclosed toothed disc on to the anchor column, and moving the leveling base and mid-plate axially downwardly along the anchor column until the bottom portion of the mid-plate frictionally contacts the top surface of both the first and second placed tiles; and exerting an axial downward force upon the closed top portion of the leveling base so as to overcome the biasing of the compression spring and to force of the leveling base axially downwardly into closer proximity with the mid-plate which responsively forces the anchor column axially upwardly through the axially aligned medial hole defined in the toothed disc and wherein some number of the plurality of spaced annular rings carried on the anchor column pass through the axially aligned medial hole defined in the toothed disc, and the tip portions of the plural angulated teeth frictionally engage with the horizontal bottom surface of the plurality of spaced annular rings to effectively secure the leveling base, the mid-plate and the anchor at a predetermined distance from one another, and the simultaneous frictional engagement of the bottom portion of the mid-plate, and the continuous spring biasing provided by the compression spring move and positionally maintain the two previously placed adjacent tiles in a planar orientation; and allowing an amount of time to pass to allow the substrate to harden/cure and to positionally secure the first and second placed tiles in the substrate;

intentionally striking the leveling base outer circumferential surface with a blow sufficient to cause the anchor column to breakable a/destructively separate from the base portion at the frangible interconnection along the length of the anchor column extension, and permanently leaving the base portion in the hardened/cured substrate below the adjacent placed tiles; and providing and placing grout in the space between the first and second placed tiles to fill the space and cover any portion of the frangible interconnection remaining between the first and second placed tiles; and removing the separated anchor column from the toothed disc within the leveling base and mid-plate so that the leveling base and mid-plate may be reused.

20. The tile lippage control and tile spacing system of claim 1 and wherein the anchor is formed of a plastic selected from the group consisting of homopolymer material, Acetal, polyoxymethylene, ABS, ABS-PC, Nylon, Glass filled nylon, Vinyl, HDPE, Poly-Propylene and plastics having glass fibers.

* * * * *